US008851598B2

(12) United States Patent
Usuda et al.

(10) Patent No.: US 8,851,598 B2
(45) Date of Patent: Oct. 7, 2014

(54) PRINTING DEVICE AND PRINTING METHOD

(75) Inventors: Hidenori Usuda, Matsumoto (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 932 days.

(21) Appl. No.: 12/941,949

(22) Filed: Nov. 8, 2010

(65) Prior Publication Data

US 2011/0109673 A1 May 12, 2011

(30) Foreign Application Priority Data

Nov. 9, 2009 (JP) ..... 2009-255791
Apr. 9, 2010 (JP) ..... 2010-090155

(51) Int. Cl.

| | |
|---|---|
| ***B41J 29/38*** | (2006.01) |
| ***B41J 2/21*** | (2006.01) |
| ***B41J 3/60*** | (2006.01) |
| ***B41J 29/393*** | (2006.01) |

(52) U.S. Cl.

CPC ..... *B41J 29/393* (2013.01); *B41J 2/2114* (2013.01); *B41J 3/60* (2013.01)
USPC ..... 347/9; 347/14

(58) Field of Classification Search

USPC ..... 347/100, 9, 14
See application file for complete search history.

(56) References Cited

U.S. PATENT DOCUMENTS

| | | | | |
|---|---|---|---|---|
| 7,407,277 | B2 | 8/2008 | Yoneyama | |
| 7,562,957 | B2 * | 7/2009 | Mills et al. | 347/15 |
| 2003/0025779 | A1 * | 2/2003 | Miyazaki | 347/171 |
| 2010/0066780 | A1 * | 3/2010 | Akatsuka | 347/14 |

FOREIGN PATENT DOCUMENTS

JP 2008-087287 A 4/2008

* cited by examiner

*Primary Examiner* — Laura Martin
(74) *Attorney, Agent, or Firm* — Kilpatrick Townsend & Stockton LLP

(57) ABSTRACT

The printing device including: a first setting unit configured to set printing mode of a main image and to set either front-surface printing mode for printing a background image on the medium and then printing the main image on the background image or rear-surface printing mode for printing the main image on the medium and then printing the background image on the main image; and a second setting unit configured to set a printing mode of an additional image printed in association with the printing of the main image and to set either front-surface printing mode for printing a background image for the additional image on the medium and then printing the additional image on the background image for the additional image or rear-surface printing mode for printing the additional image on the medium and then printing the background image for the additional image on the additional image.

10 Claims, 12 Drawing Sheets

PRINTING DEVICE AND PRINTING METHOD

INCORPORATED BY REFERENCE

The entire disclosure of Japanese Patent Application No.: 2009-255791, filed Nov. 9, 2009 and 2010-090155, filed Apr. 9, 2010 are expressly incorporated by reference herein.

BACKGROUND

1. Technical Field

The present invention relates to a printing device and a printing method.

2. Related Art

As a printing device, an ink jet printer (hereinafter, referred to as a printer) having a head for discharging an ink from nozzles to a medium is known. Recently, an image has been printed on a transparent film or the like in addition to a paper medium. In the case where an image is printed on a transparent film, since a background image is printed by a white ink, the color development property of the image is excellent. In addition, a method of inspecting a non-discharge nozzle based on reflected light and transmitted light to the image printed on the transparent film is suggested (for example, JP-A-2008-87287).

In the case where a background image using a white ink and a color image are superposed and printed on a transparent film, there is a printer capable of selecting a front-surface printing mode in which the background image is first printed on the transparent film and the color image is printed on the background image and a rear-surface printing mode in which the color image is first printed on the transparent film and the background image is printed on the color image. In such a printer, in addition to the color image (main image), for example, an additional image such as a non-discharge inspection pattern may be printed so as to be superposed on the background image which is printed by the white ink. In this case, if the additional image is printed according to a printing mode of the main image, for example, the background image may be interposed between a sensor for reading the additional image and the additional image. Accordingly, it may not be possible to check the content of the additional image.

SUMMARY

An advantage of some aspects of the invention is that the content of an additional image can be checked.

According to an aspect of the invention, there is provided a printing device for discharging inks from nozzles according to a set mode and printing an image on a medium, the printing device including: a first setting unit configured to set a printing mode of a main image and to set either of a front-surface printing mode for printing a background image on the medium and then printing the main image on the background image or a rear-surface printing mode for printing the main image on the medium and then printing the background image on the main image; and a second setting unit configured to set a printing mode of an additional image printed in association with the printing of the main image and to set either a front-surface printing mode for printing a background image for the additional image on the medium and then printing the additional image on the background image for the additional image or a rear-surface printing mode for printing the additional image on the medium and then printing the background image for the additional image on the additional image.

The other features of the invention will be clarified from the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
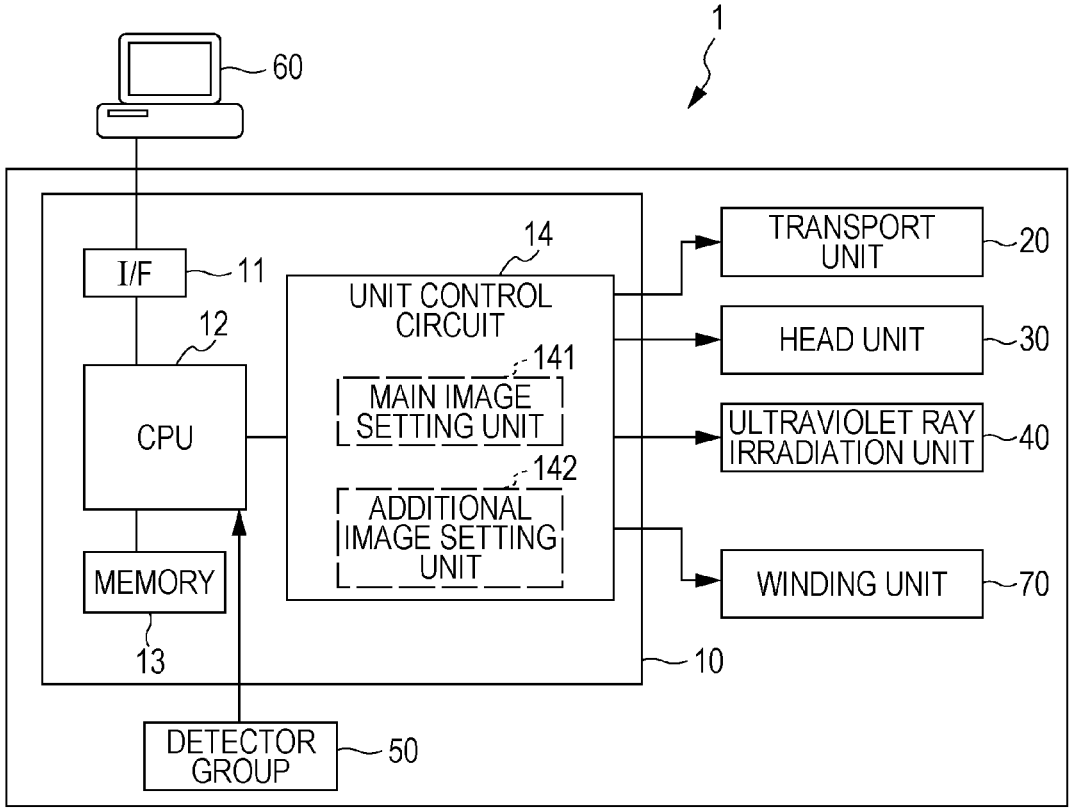
FIG. 1 is a block diagram showing the overall configuration of a printing system.

The following matter will be apparent from the specification and the accompanying drawings.

That is, there is provided a printing device for discharging inks from nozzles according to a set mode and printing an image on a medium, the printing device including: a first setting unit configured to set a printing mode of a main image and to set either a front-surface printing mode for printing a background image on the medium and then printing the main image on the background image or a rear-surface printing mode for printing the main image on the medium and then printing the background image on the main image; and a second setting unit configured to set a printing mode of an additional image printed in association with the printing of the main image and to set either a front-surface printing mode for printing a background image for the additional image on the medium and then printing the additional image on the background image for the additional image or a rear-surface printing mode for printing the additional image on the medium and then printing the background image for the additional image on the additional image.

According to such a printing device, it is possible to print a printed material for which it is possible to check the content of the additional image.

In the printing device, if the additional image is read by a sensor, the second setting unit sets the printing mode of the additional image to a printing mode for printing an image in which the background image for the additional image is not interposed between the sensor and the additional image.

According to such a printing device, it is possible to enable the sensor to read the additional image.

In the printing device, the medium after printing is wound in a roll shape. If the medium is wound in a state in which the printed surface of the medium is located outside, the second setting unit sets the printing mode of the additional image to the front-surface printing mode, and, if the medium is wound in a state in which the printed surface of the medium is located inside, the second setting unit sets the printing mode of the additional image to the rear-surface printing mode.

According to such a printing device, it is possible to check the content of the additional image from the outside of the medium wound in the roll shape.

In the printing device, a user selection unit for enabling a user to select the printing mode of the main image and the printing mode of the additional image is further included.

According to such a printing device, it is possible to check the content of the additional image according to the use of the user.

In the printing device, the relative position of the medium and the nozzles is relatively moved in one direction of a predetermined direction, the inks are discharged from the nozzles, and the image is printed on the medium, and, for the front-surface printing mode and the rear-surface printing mode, if the printing mode of the main image and the printing mode of the additional image are different, the relative position of the medium and the nozzles is relatively moved in the other direction of the predetermined direction before the additional image or the background image for the additional image is printed.

According to such a printing device, it is possible to print an image according to each printing mode, to equalize the nozzles for printing the main image and the additional image, and to equalize the nozzles for printing the background image for the main image and the background image for the additional image.

In the printing device, the margin amount of the background image for the additional image with respect to the additional image is greater than the margin amount of the background image with respect to the main image.

According to such a printing device, it is possible to superpose and print the additional image and the background image for the additional image.

In the printing device, the relative position of the medium and the nozzles is relatively moved in one direction of a predetermined direction, the inks are discharged from the nozzles and the image is printed on the medium, and, for the front-surface printing mode and the rear-surface printing mode, if the printing mode of the main image and the printing mode of the additional image are different, one set of the nozzles located on one direction side or the other direction side of the predetermined direction of rather than the nozzles for printing the main image and the additional image is used as the nozzle for printing the background image, and the other nozzles are used as nozzles for printing the background image for the additional image.

According to such a printing device, it is possible to print an image according to each printing mode without relative reverse movement between the nozzles and the medium and to equalize the nozzles for printing the main image and the additional image.

In the printing device, the main image is printed by a first ink and the background image is printed by the first ink and a second ink.

According to such a printing device, it is possible to print a background image of a desired color.

There is provided a printing method including: at a first setting unit, setting either a front-surface printing mode for printing a background image on a medium and then printing a main image on the background image or a rear-surface printing mode for printing the main image on the medium and then printing the background image on the main image as the printing mode of the main image; printing the main image and the background image according to the mode set by the first setting unit; at a second setting unit, setting either a front-surface printing mode for printing a background image for an additional image printed in association with the printing of the main image on the medium and then printing the additional image on the background image for the additional image or a rear-surface printing mode for printing the additional image on the medium and then printing the background image for the additional image on the additional image as the printing mode of the additional image; and printing the additional image and the background image for the additional image according to the mode set by the second setting unit.

According to such a printing method, it is possible to print a printed material for which it is possible to check the content of the additional image.

First Embodiment

Printing System

An example of a printing device includes an ink jet printer (hereinafter, referred to as a printer 1), and an embodiment will be described in a printing system in which the printer 1 and a computer 60 are connected.

Figure 2A:
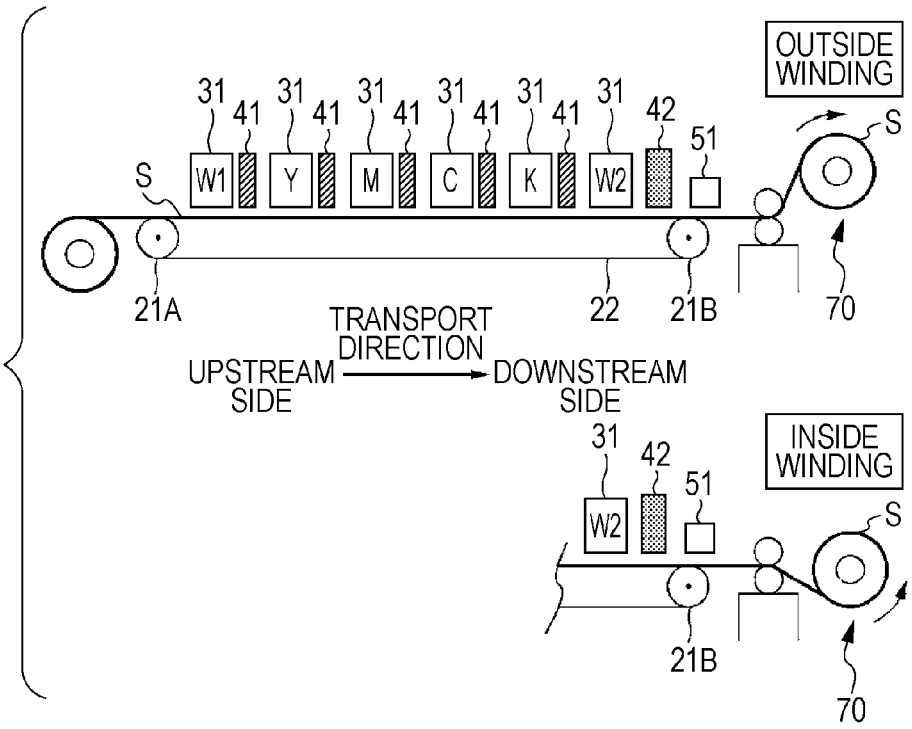
FIG. 2A is a schematic cross-sectional view of a printer and FIG. 2B is a diagram showing arrangement of heads of a head unit.
Figure 2B:
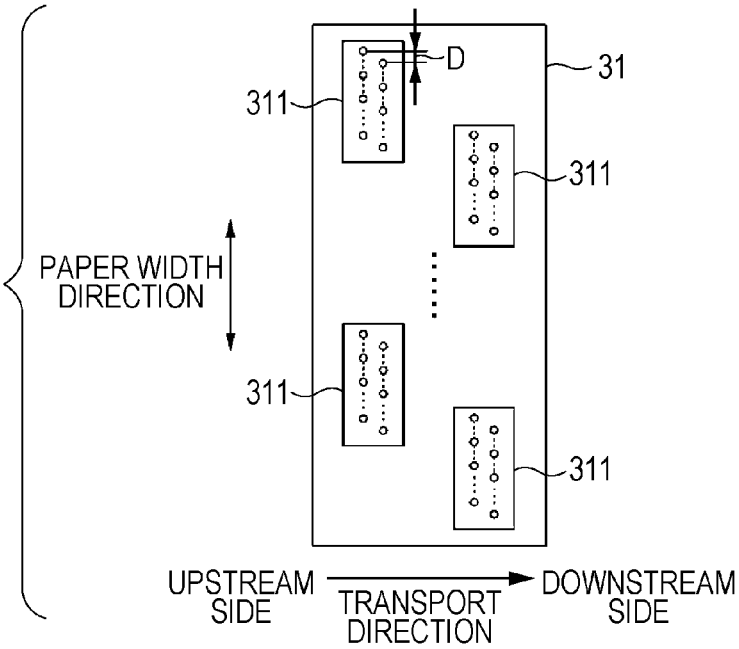

FIG. 1 is a block diagram showing the overall configuration of the printing system, FIG. 2A is a schematic cross-sectional view of the printer 1, and FIG. 2B is a diagram showing an arrangement of short heads 311 of a head unit 31. Since the computer 60 is connected to the printer 1 in a communicable manner so as to enable the printer 1 to print an image, printing data corresponding to the printed image is output to the printer 1. In the computer 60, a program (printer driver) for converting image data output from an application program into printing data is installed. This printer driver is recorded in a recording medium (computer-readable recording medium) such as a flexible disk FD or a CD-ROM. Alternatively, the printer driver may be downloaded to the computer 60 through the Internet.

The printer 1 which receives a printing command and printing data from the computer 60 controls each unit by a controller 10 so as to form images on a continuous medium S. A detector group 50 monitors the internal status of the printer 1 and the controller 10 controls each unit based on a detection result.

The controller 10 is a control unit for controlling the printer 1. An interface unit 11 performs data transmission/reception between the computer 60 and the printer 1. A CPU 12 is an arithmetic processing unit for controlling the overall printer 1. A memory 13 secures a region for storing a program of the CPU 12, a work area, or the like. The CPU 12 controls each unit by a unit control circuit 14.

A transport unit 20 transports a continuous medium S. The transport unit includes transport rollers 21A and 21B and a transport belt 22 and transports the continuous medium S at a predetermined transport rate in a transport direction at the time of printing. In addition, in order to prevent positional shift of the medium during printing, the medium S is sucked from the lower side and the medium S is vacuum sucked to the transport belt 22.

The head unit 30 has a plurality of heads 31 for discharging inks to the medium. As shown in FIG. 2A, the plurality of heads 31 is aligned along a medium transport direction. A first white head 31 (W1) for discharging a white ink, a yellow head 31 (Y) for discharging a yellow ink, a magenta head 31 (M) for discharging a magenta ink, a cyan head 31 (C) for discharging a cyan ink, a black head 31 (K) for discharging a black ink, and a second white head 31 (W2) for discharging a white ink are sequentially arranged from an upstream side of the transport direction.

As shown in FIG. 2B, a plurality of short heads 311 is aligned in a paper width direction in a lower surface of each head 31, and a plurality of nozzles which is an ink discharging unit is provided in a lower surface of each short head 311. In addition, the plurality of nozzles is aligned in the lower surface of each short head 311 at a predetermined interval D in the paper width direction, and the short heads 311 are arranged such that a nozzle interval between neighboring short heads 311 becomes the predetermined interval D. Therefore, the plurality of nozzles is arranged in the lower surface of each head 31 at the predetermined interval D in the paper width direction. A pressure chamber (not shown) in which the ink is contained and a driving element (for example, a piezoelectric element) for changing the capacitance of the pressure chamber and discharging the ink are provided in each nozzle. By applying a driving signal to the driving element, the driving element is deformed and the pressure chamber is expanded and contracted due to deformation, thereby discharging the ink.

In addition, in the present embodiment, an "ultraviolet curing type ink" cured by irradiating ultraviolet rays is used as the ink. The ultraviolet curing type ink (hereinafter, referred to as ink) is prepared by adding a supplemental agent such as an antifoam agent or a polymerization inhibitor to a mixture of a vehicle, photopolymerization initiator and a pigment. The vehicle is prepared by adjusting the viscosity of an oligomer or a monomer having photopolymerization hardenability using a reactive diluent. The ink includes both an aqueous ink and an oil-based ink.

An ultraviolet ray irradiation unit 40 has irradiators (a pre-irradiator 41 and a main irradiator 42) for irradiating ultraviolet rays to the ultraviolet curing type inks discharged from the heads 31 onto the medium and curing the inks. Each of the irradiators 41 and 42 has a lamp (for example, a metal halide lamp, an LED or the like) for irradiating ultraviolet rays to the ultraviolet curing type inks and curing the inks. By adjusting the irradiation amount (irradiation intensity (mJ/$cm^2$), number of times of irradiation, or the like) of the ultraviolet rays by the irradiators 41 and 42, the ultraviolet curing type inks may be completely cured or may not be completely cured. In addition, the pre-irradiator 41 is provided between the heads 31 for discharging different color inks. The main irradiator 42 is provided on the side furthest downstream of the transport direction. The pre-irradiator 41 irradiates ultraviolet rays with irradiation intensity weaker than that of the main irradiator 42. Therefore, the ultraviolet rays are irradiated to the ultraviolet curing type ink discharged from the heads 31 to the medium S by the pre-irradiator 41 such that the inks are not completely cured (semi-cured state) and the ultraviolet rays are irradiated by the main irradiator 42 such that the inks are completely cured (completely cured state). In addition, a reading sensor 51 is provided on a further downstream side of the main irradiator 42. Since the reading sensor 51 (sensor) is provided on the side (upper side) of the heads 31 with respect to the continuous medium S, the printed surface of the continuous medium S and the reading sensor 51 face each other.

In such a printer 1, the controller 10 transports the continuous medium S on the transport belt 22 at a constant rate without stoppage when receiving the printing data. At this time, the heads 31 and the irradiators 41 and 42 face the continuous medium S, the ultraviolet curing type inks are discharged from the heads 31 to the medium S, and the ultraviolet curing type inks are cured by the irradiators 41 and 42. As a result, the image is printed on the medium. After printing, the continuous medium S is rolled in a roll shape by a winding unit 70, as shown in FIG. 2A. The winding unit 70 of the present embodiment can perform two winding methods including a winding method (outside winding) in which the printed surface is located outside as shown in an upper diagram of FIG. 2A and a winding method (inside winding) in which the printed surface is located inside as shown in a lower diagram of FIG. 2A.

Regarding Printed Image

Figure 3:
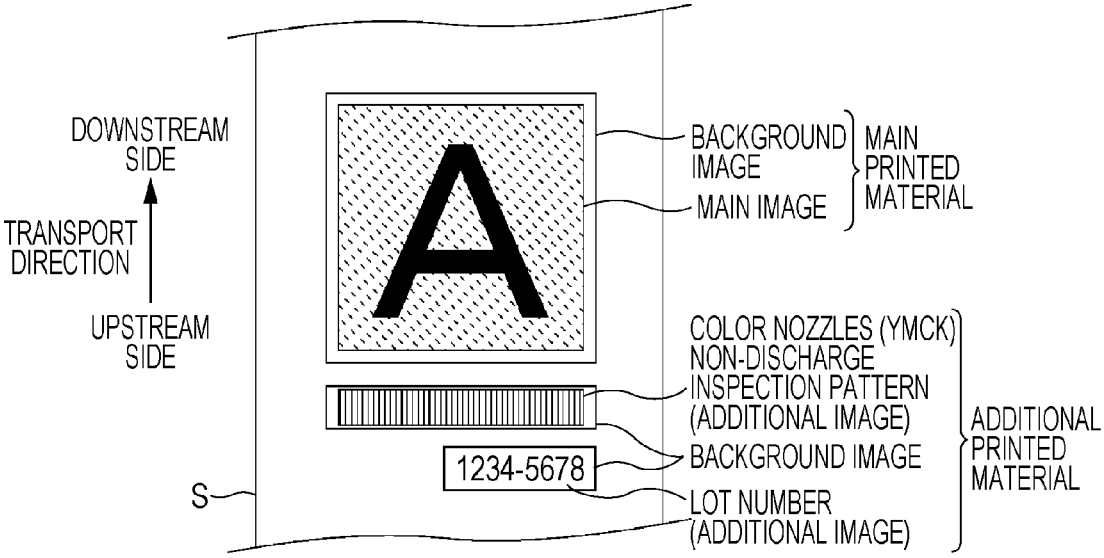
FIG. 3 is a diagram explaining a printed material which is an example of the present embodiment.

FIG. 3 is a diagram explaining a printed material which is an example of the present embodiment. Two printed materials including a "main printed material" in which a "main image" printed using four color inks (including K) and a "background image" printed using the white ink are superposed and an "additional printed material" in which an "additional image" printed using color inks of four colors and a "background image" printed using the white ink are superposed were printed. The continuous medium S used in the present embodiment is a transparent medium (for example, a transparent resin film or the like). Accordingly, the white background image is superposed and printed on the image printed using the color inks of four colors such that the color development property of the color image is improved and the opposite side of the printed material is prevented from being transparent. In addition, in FIG. 3, the additional printed material is printed at a position corresponding to the upstream side of the main printed material in the transport direction. The invention is not limited thereto and the additional printed material may be located at a position corresponding to the downstream side of the main printed material in the transport direction. In FIG. 3, since only one main printed material is formed on the continuous medium S, one additional printed material is formed with respect to one main printed material. However, the invention is not limited thereto. For example, in the case where a plurality of main printed material is continuously printed on the continuous medium S, one additional printed material may be printed for each main printed material of predetermined number.

A main image indicates an image instructed to be printed by a user. An additional image indicates an image indicating information about printing of the main image. In FIG. 3, a non-discharge inspection pattern for color nozzles (YMCK) of four colors is formed as the "additional image". The non-discharge inspection pattern is configured by a dot array formed by the nozzles of four colors (YMCK) used for printing the main image. The discharge/non-discharge from the nozzles is determined depending on whether or not the dot array is normally formed by the nozzles. By printing the non-discharge inspection pattern of the nozzles used for printing the main image together with the main image, the user can check whether or not the main image is printed without the non-discharge nozzle. The non-discharge inspection pattern takes a role of quality guarantee indicating that the main image is normally printed without the non-discharge nozzle. In FIG. 3, in addition to the non-discharge inspection pattern, a lot number of the main image is printed as the additional image. In addition, the type of the additional image is not limited thereto and, as information on printing of the main image, for example, a product serial number of the printer 1 for performing printing or information indicating the type of the medium or the main image may be printed. In the present embodiment, since the main printed material is printed on the continuous medium S, the main printed material may be trimmed from the continuous medium S in a subsequent step. As a mark (additional image) indicating the trimmed position at that time, marks (so-called register mark) such as L-shaped marks or cross-shaped marks may be printed at positions corresponding to four corners of the main image or two corners on a diagonal line.

The additional image may be read by visual observation of the user or may be read by the reading sensor 51 shown in FIG. 2 or a sensor of an external device (for example, a device for clipping the main printed material). Although the lot number is printed as numerals in FIG. 3, the invention is not limited thereto and the additional image may be a pattern such as a barcode.

In addition, the additional image may be printed in association with printing of the main image. For example, information associated with printing may be printed or printing may be performed in association with the printing operation. For example, printing may be performed in order to check printed content or a printed state. A point of time when the additional image is printed may be before or after printing of the main image or as needed while a plurality of main images is printed. The additional image may be printed by the instruction of the user or may be instructed and printed by the user in order to check the printed content or the printed state of the main image.

Regarding Printing Mode

Figure 4:
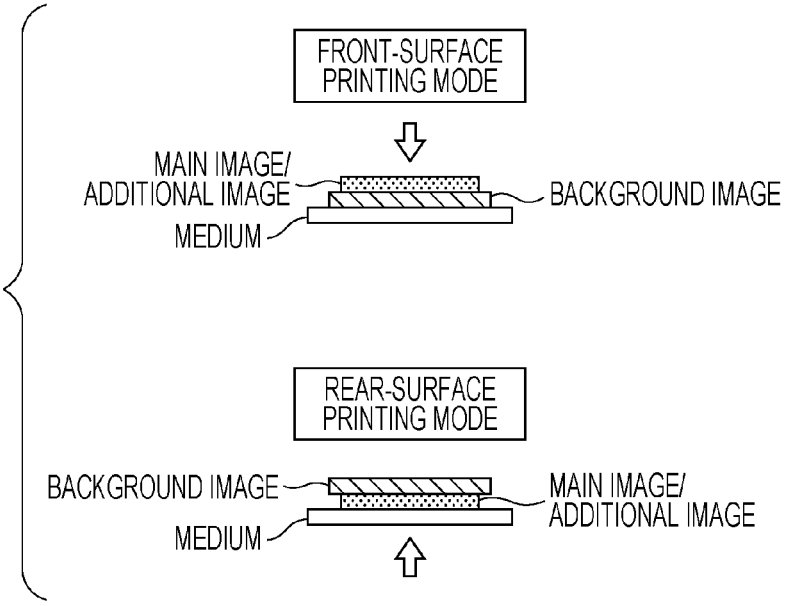
FIG. 4 is a diagram explaining a printing mode of a main printed material and an additional printed material.

FIG. 4 is a diagram explaining a printing mode of a main printed material and an additional printed material. In the printer 1 of the present embodiment, in the case where the color image (main image and additional image) and the white background image are superposed and printed on a transparent medium (transparent film or the like), two types of printing modes including a "front-surface printing mode" and a "rear-surface printing mode" may be selected so as to perform printing. As shown in an upper diagram of FIG. 4, in the front-surface printing mode, a background image is first printed in a predetermined area on the medium and a color image (main image or additional image) is printed on the background image. Therefore, in the printed material printed in the front-surface printing mode, the color image is viewed from the printed surface. In contrast, as shown in a lower diagram of FIG. 4, in the rear-surface printing mode, a color image (main image or additional image) is first printed in a predetermined area on the medium and a background image is printed on the color image. Therefore, in the printed material printed in the rear-surface printing mode, the color image is viewed through the medium.

In the printer 1 of the present embodiment, in order to realize the front-surface printing mode and the rear-surface printing mode, as shown in FIG. 2, two heads 31 (W1 and W2) for discharging the white ink are provided on the uppermost upstream side and the lowermost downstream side of the transport direction. That is, the white heads 31 (W1 and W2) are provided on the upstream side and the downstream side of the transport direction of the heads 31 for discharging the inks (YMCK) of four colors, respectively. Therefore, in the front-surface printing mode, the background image is first printed in a predetermined area on the medium by the first white head 31 (W1) of the upstream side and the color image is printed on the background image by the heads 31 (YMCK) of four colors located on the central portion. In the rear-surface printing mode, the color image is first printed in a predetermined area on the medium by the heads 31 (YMCK) of four colors located on the central portion and the background image is printed on the color image by the second white head 31 (W2) of the downstream side.

Regarding Setting of Printing Mode

Figure 5:
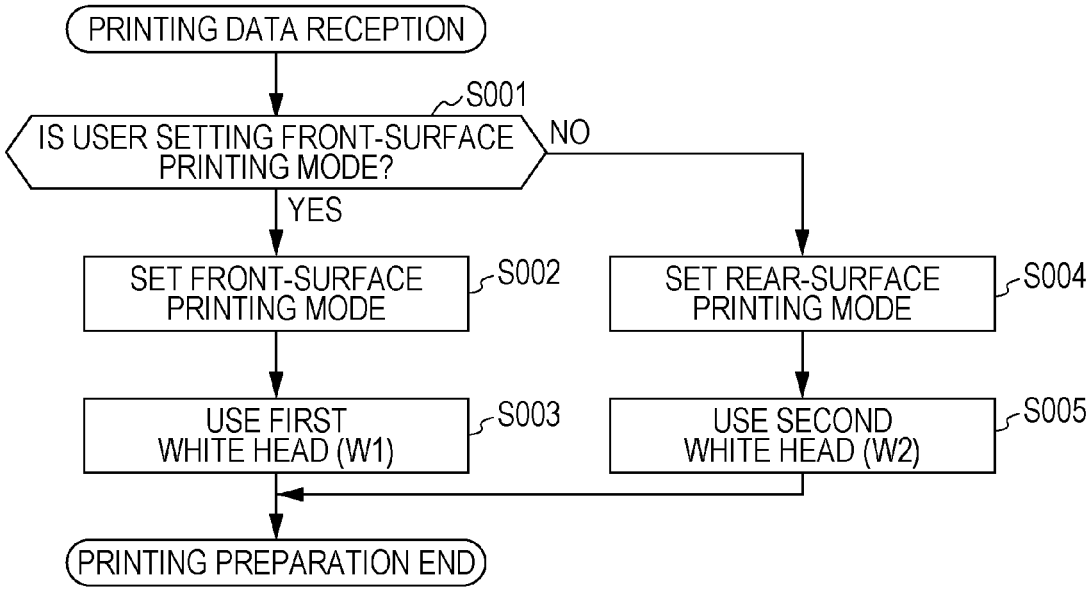
FIG. 5 is a flowchart illustrating a process of setting a printing mode of a main printed material by a main image setting unit.

FIG. 5 is a flowchart illustrating a process of setting a printing mode of a main printed material by a main image setting unit 141. As shown in FIG. 1, in the printer 1 of the present embodiment, the "main image setting unit 141 (first setting unit)" is provided within the controller 10. In the main printed material, the printing mode is determined by the setting of the user. In addition, in the printing system of the present embodiment, the printing data is prepared by the printer driver in the computer 60 connected to the printer 1. Therefore, the printer driver displays a "printing mode setting window (not shown)" on a display or the like of the computer 60 when the color image and the white background image are instructed to be superposed and printed or when a transparent medium is set as a medium for printing an image. The user can set either the front-surface printing mode or the rear-surface printing mode by the window. The printer driver transmits printing information indicating the printing mode or the like set by the user to the printer 1, together with the prepared printing data.

Thereafter, as shown in FIG. 5, the main image setting unit 141 determines whether the printing mode set by the user is the front-surface printing mode or not, based on the received printing information (S001). If the printing mode set by the user is the front-surface printing mode (S001→Y), the main image setting unit 141 sets the printing mode to the front-surface printing mode (S002). In this case, the main image setting unit 141 sets the head 31 used for printing the background image to the first white head 31 (W1) and transmits the printing data of the background image to the first white head 31 (W1) (S003). Therefore, the background image can be first printed in the predetermined area on the medium by the first white head 31 (W1) of the upstream side of the transport direction and the color image can be printed on the background image by the four color heads 31 (YMCK) of the central portion in the transport direction.

In contrast, if the printing mode set by the user is not the front-surface printing mode (S001→N), the main image setting unit 141 sets the printing mode to the rear-surface printing mode (S004). In this case, the main image setting unit 141 sets the head 31 used for printing the background image to the second white head 31 (W2) and transmits the printing data of the background image to the second white head 31 (W2) (S005). Therefore, the color image can be first printed in the predetermined area on the medium by the four color heads 31 (YMCK) of the central portion of the transport direction and the background image can be printed on the color image by the second white head 31 (W2) of the downstream side in the transport direction.

Accordingly, the printer 1 can print the main printed material by the printing mode set by the user. In addition, the main image setting unit 141 may set only the printing mode for printing the main printed material, and the other control unit may determine the white-ink head 31 to be used or transmit the printing data for the background image to the white-ink head 31 to be used, based on the printing mode set by the main image setting unit 141.

In the present embodiment, as shown in FIG. 3, the additional printed material is printed in addition to the main printed material. Here, it is assumed that the additional printed material can be printed in only the same printing mode as the main printed material. That is, the printing mode of the main printed material and the printing mode of the additional printed material cannot be independently set. For example, if the user sets the main printed material to be printed in the rear-surface printing mode, the additional printed material is printed in the same rear-surface printing mode. In the printer 1 shown in FIG. 2, the reading sensor 51 of the additional image is provided on the side of the heads 31 (printed surface side). Therefore, when the additional printed material is printed in the rear-surface printing mode, the background image is interposed between the reading sensor 51 and the additional image such that the reading sensor 51 cannot read the additional image. That is, as the result of printing the additional printed material in the printing mode matching the printing mode of the main printed material, if the background image is printed on the side of the reading sensor 51 rather than the additional image, the reading sensor 51 cannot read the content of the additional image. If the reading sensor 51 is provided on the printed surface side (head side) and the transport belt side according to the positional relationship between the additional image and the background image in the front-surface printing mode and the rear-surface printing mode, cost is increased.

In the present embodiment, as shown in FIG. 2, the continuous medium S is wound in a roll shape. Therefore, as shown in an upper diagram of FIG. 2, in the case where the continuous medium S is wound such that the printed surface (the surface of the head side) is located outside (outside winding), if the additional printed material is printed in the rear-surface printing mode similar to the main printed material, the background image is located on the upper side of the printed surface rather than the additional image and thus the content of the additional image cannot be checked from the outside of the medium wound in the roll shape.

An advantage of the present embodiment is that the content of the additional image can be checked by the reading sensor 51 or the content of the additional image can be checked from the outside of the roll-shaped medium. That is, an advantage of the present embodiment is that the additional image can be printed such that the content of the additional image can be checked. Accordingly, in the printer 1 of the present embodiment, as shown in FIG. 1, both the main image setting unit 141 and the additional image setting unit 142 (second setting unit) are provided in the controller 10 so as to independently set the printing mode of the main printed material and the printing mode of the additional printed material. In addition, the reading sensor of the additional image may be provided on the opposite side (opposite side of the printed surface) of the heads 31 to the medium. In this case, by printing the additional printed material in the rear-surface printing mode, the reading sensor 51 can read the additional image.

Figure 6A:
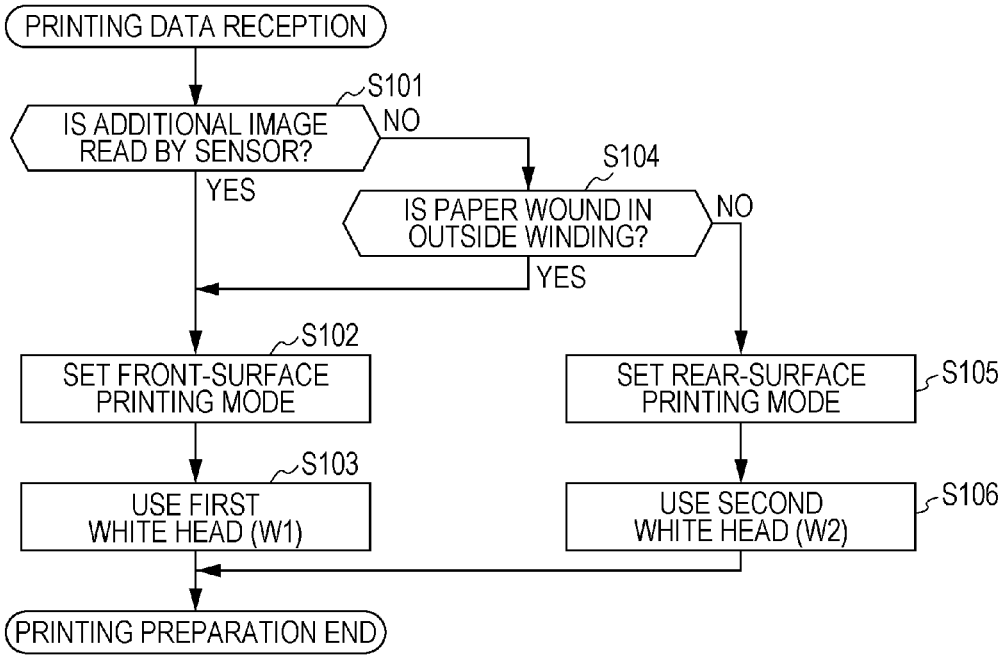
FIG. 6A is a flowchart illustrating a process of setting a printing mode of an additional printed material by an additional image setting unit.
Figure 6B:
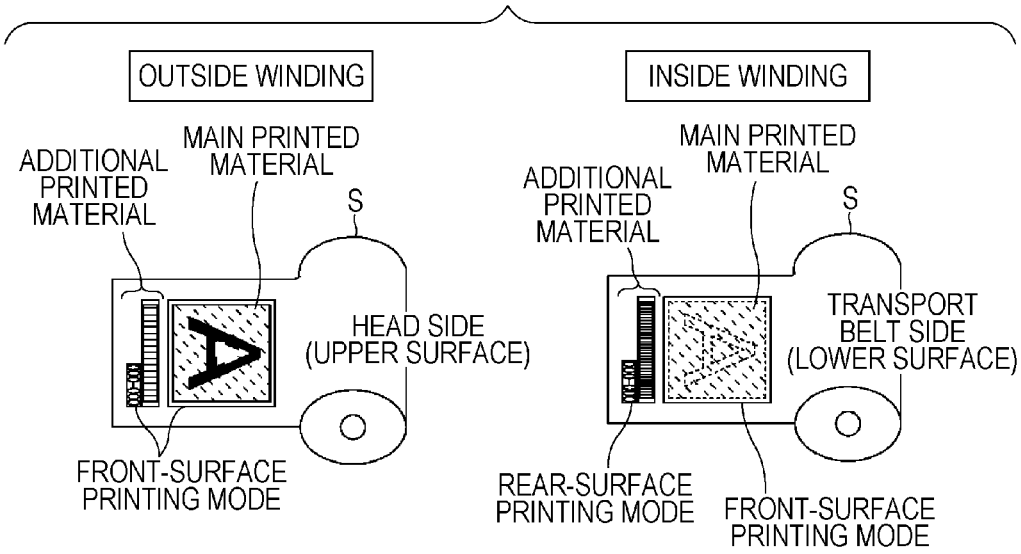
FIG. 6B is a diagram showing a difference in printing position of an additional image due to a difference in winding method of a continuous medium.

FIG. 6A is a flowchart illustrating a process of setting the printing mode of the additional printed material by the additional image setting unit 142, and FIG. 6B is a diagram showing a difference in printing position of the additional image due to a difference in winding method of the continuous medium S. As shown in FIG. 6A, the additional image setting unit 142 determines whether the additional image to be printed is an image read by the reading sensor 51 or not, based on the printing information (or predetermined printing setting) received from the computer 60 (S101). In the printer 1 of the present embodiment, since the reading sensor 51 is located on the side (printed surface side) of the head 31 (FIG. 2), if the additional image is read by the reading sensor 51 (S101→Y), the additional image setting unit 142 sets the printing mode of the additional printed material to the front-surface printing mode (S102). In this case, the additional image setting unit 142 determines the head 31 used for printing the background image for the additional image as the first white head 31 (W1) and transmits the printing data of the background image for the additional image to the first white head 31 (W1) (S103). Therefore, the background image is first printed in the predetermined area on the medium by the first white head 31 (W1) and, thereafter, the additional image is printed on the background image by the four color heads 31 (YMCK). Since the additional image is located on the side of the reading sensor 51 rather than the background image, the reading sensor 51 can read the content of the additional image.

In addition, in the printed material shown in FIG. 3, two types of additional images including "non-discharge inspection pattern" and "lot number" are printed. In the case where the plurality of additional images is printed, if at least one of the plurality of additional images is read by the reading sensor 51, the additional image setting unit 142 sets the printing mode of the additional printed material to the front-surface printing mode.

In contrast, if the additional image is not read by the reading sensor 51 (S101→N), the additional image setting unit 142 determines the printing mode by the winding method of the continuous medium S. For example, in the left diagram of FIG. 6B, a state in which the main printed material is printed in the front-surface printing mode (printed surface side) and the continuous medium S is wound by outside winding (such that the printed surface is located outside) is shown. If the continuous medium S is wound in outside winding, since the printed surface is located outside, the medium surface viewed from the outside on the winding end of the continuous medium S is the printed surface. If the continuous medium S is wound in outside winding (S104→Y), the additional image setting unit 142 sets the printing mode of the additional printed material to the front-surface printing mode (S102). Accordingly, since the additional image is located on the outside of the roll-shaped medium S rather than the background image, it is possible to check the content of the additional image even after the continuous medium S is wound in the roll shape. For example, even when there is a plurality of roll-shaped printed media, if the additional image indicates the type of the main image, it is possible to easily check on which roll-shaped medium which main image is printed.

In contrast, in the right side of FIG. 6B, a state in which the main printed material is printed in the front-surface printing mode (printed surface side) and the continuous medium S is wound in inside winding (such that the printed surface is located inside) is shown. If the continuous medium S is wound in inside winding, since the printed surface is located inside, the medium surface viewed from the outside on the winding end of the continuous medium S is the surface opposed to the printed surface. If the continuous medium S is wound in inside winding (S104→N), the additional image setting unit 142 sets the printing mode of the additional printed material to the rear-surface printing mode (S105). Accordingly, since the additional image can be viewed from the outside of the roll-shaped medium S through the medium, it is possible to easily check the content of the additional image even after the continuous medium S is wound in the roll shape.

In the present embodiment, the main image setting unit 141 and the additional image setting unit 142 are provided in the printer 1 (controller 10) and the printing mode of the main image (main printed material) and the printing mode of the additional image (additional printed material) are independently set. Therefore, the printing mode of the additional image may be set according to the position of the reading sensor 51 such that the reading sensor 51 can read the additional image or the printing mode of the additional image may be set according to the medium surface of the outside when the continuous medium S is wound such that the content of the additional image can be checked from the outside of the roll-shaped continuous medium S. That is, in the present embodiment, it is possible to form a printed material in which it is possible to check the content of the additional image.

In addition, when the printing mode of the main image (main printed material) and the printing mode of the additional image (additional printed material) are independently set, the main image and the additional image may be printed on the same side as the background image or the main image and the additional image may be printed on the side different from that of the background image. According to the flowchart of FIGS. 5 and 6A, the white heads 31 (W1 and W2) for printing the background image of each image are determined according to the printing modes of the main image and the additional image. Therefore, if the printing modes of the main image and the additional image are different, both the first white head 31 (W1) and the second white head 31 (W2) are used. For example, as shown in the right diagram of FIG. 6B, if the main printed material is printed in the front-surface printing mode and the additional printed material is printed in the rear-surface printing mode, the background image for the main image is printed by the first white head 31 (W1) and the background image for the additional image is printed by the second white head 31 (W2).

Although, in the flowchart of FIG. 6A, if the additional image is not read by the reading sensor 51 (S101→N), the printing mode of the additional image (additional printed material) is determined by the winding method of the continuous medium S (S104), the invention is not limited thereto and, for example, the user may set the printing mode of the additional image. Therefore, for example, the printer driver installed in the computer 60 may display the "additional image printing mode setting window (not shown) on the display or the like of the computer 60, when the printer driver is instructed to print the additional image on the transparent medium. The printer driver may enable the user to select the printing mode of the main image and the printing mode of the additional image. Therefore, the user can set the printing modes of the main image and the additional image to be the same or different according to use and thus printing can be performed such that the content of the additional image can be checked. In this case, a User Interface (UI) of the printer driver corresponds to a user selection unit and the printing system, in which the printer 1 and the computer 60 in which the printer driver is installed are connected, corresponds to a printing device. The invention is not limited thereto and the controller 60 of the printer 1 may function as the user selection unit. In this case, the printer 1 corresponds to the printing device.

As in the printer 1 of the present embodiment (FIG. 2), if the winding method of the continuous medium S is not changed in the printer, in the case where the additional image is not read by the reading sensor 51, the printing mode of the additional image is automatically set by the fixed winding method of the continuous medium S. In contrast, if the printer 1 does not have the reading sensor 51, the printing mode of the additional image may be set based on only the winding method of the continuous medium S, the printing mode of the additional image may be set based on the reading sensor of an external device (for example, main printed material clipping device) or the printing mode of the additional image may be set by the user.

Regarding Another Printing Example

Figure 7:
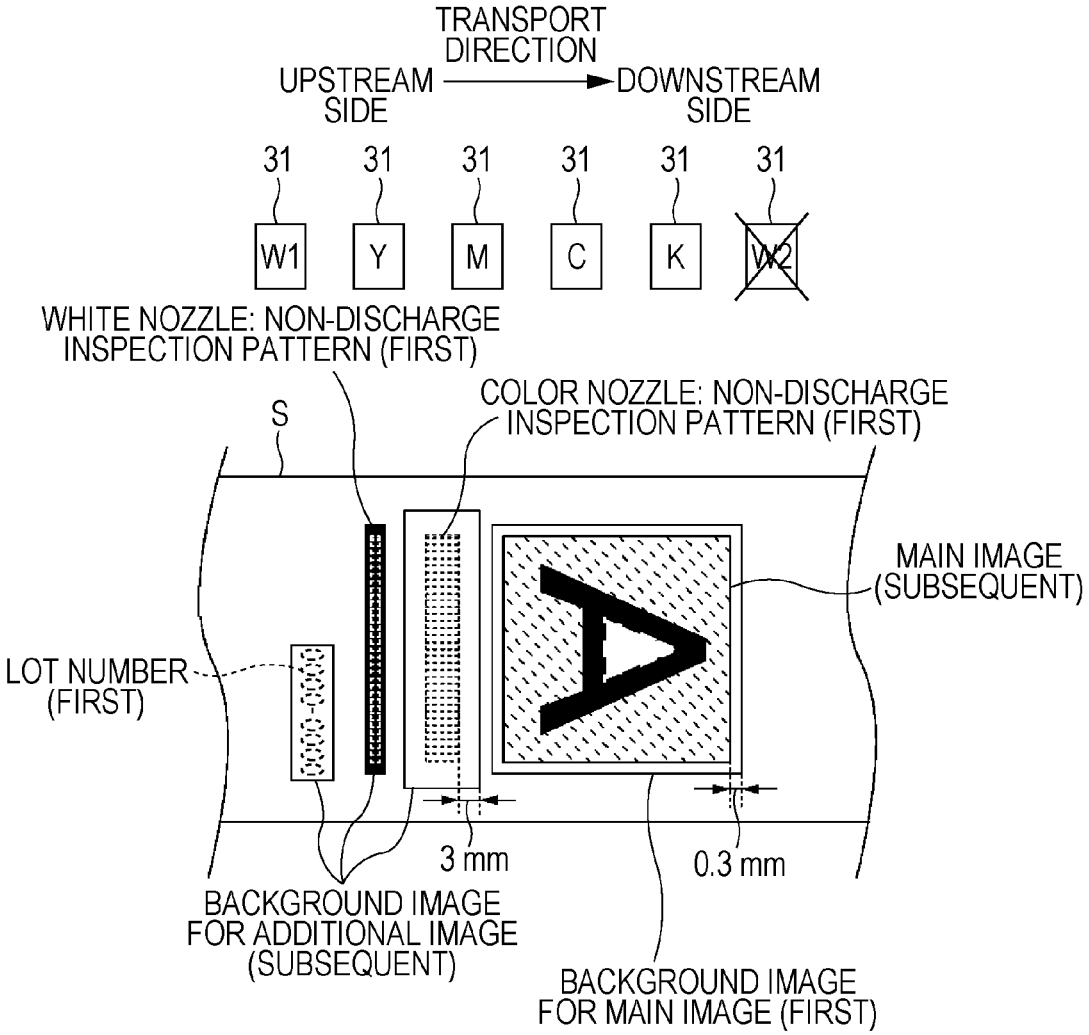
FIG. 7 is a diagram explaining another printing example in the case where the printing modes of a main image and an additional image are different.

FIG. 7 is a diagram explaining another printing example in the case where the printing modes of the main image and the additional image are different. Although the white heads 31 (W1 and W2) print the background image of each image are set according to the printing modes of the main image and the additional image in the flowchart of FIGS. 5 and 6A, but the invention is not limited thereto. Even when the printing modes of the main image and the additional images are different, either head 31 of the two white heads 31 (W1 and W2) may be used. Therefore, since the unused white head 31 of the two white heads 31 (W1 and W2) does not need to be subjected to a cleaning operation, it is possible to suppress ink consumption other than for printing.

For example, in FIG. 7, the used white head 31 (W) is determined according to the printing mode of the main image. In FIG. 7, since the main printed material is printed in the front-surface printing mode and the additional printed material is printed in the rear-surface printing mode, the first white head 31 (W1) is used and the second white head 31 (W2) is not used. In this case, in the main printed material, with respect to the predetermined area of the continuous medium S transported from the upstream side (one side) to the downstream side (the other side) of the transport direction (predetermined direction), the background image is first printed by the first white head 31 (W1) and, thereafter, the main image is printed on the background image by the four color ink heads 31 (YMCK). In contrast, in the additional printed material, after the additional image is first printed by the four color ink heads 31, the background image is printed on the additional image by the first white head 31 located on the upstream side of the four color ink heads 31 in the transport direction. Therefore, after the additional image is printed by the four color ink heads, the continuous medium S is fed in reverse from the downstream side to the upstream side of the transport direction, the medium area in which the additional image is printed and the first white head W1 face each other, and the background image is printed on the additional image.

If either the two white heads 31 (W1 and W2) located on the upstream side and the downstream side of the transport direction is used and the printing modes of the main printed material and the additional printed material are different, the continuous medium S needs to be fed in reverse direction when one background image or color image is printed. The medium position control (transport amount control) is performed, for example, based on the rotation angles or the like of the transport rollers 21A and 21B. Therefore, if the medium is transported in normal direction (from the upstream side to the downstream side) after the medium is transported in reverse direction (from the downstream side to the upstream side), an error is prone to occur in the medium position control. As a result, the print position of the first printed image (additional image in FIG. 7) and the print position of the subsequently printed image (background image in FIG. 7) are prone to be shifted. That is, the image quality of the printed material printed by feeding the continuous medium S in reverse direction may deteriorate. As shown in FIG. 7, it is preferable that the white head 31 (W) to be used is determined according to the printing mode of the main image. Therefore, the main printed material can be printed without feeding the continuous medium S in reverse direction and printing can be performed with high image quality. In contrast, since the additional printed material is printed by feeding the continuous medium S in reverse direction, image quality may deteriorate, but there is no problem in the additional printed material.

In the additional printed material, since printing is performed by feeding the continuous medium S in reverse direction before the additional image or the background image for the additional image is printed, the positional shift between the additional image and the background image is prone to occur. Therefore, the margin amount (3 mm in FIG. 7) of the background image for the additional image may be greater than the margin amount (0.3 mm in FIG. 7) of the background image for the main image. Therefore, since the additional printed material is printed by feeding the continuous medium S in reverse direction, the print positions of the additional image and the background image are prone to be shifted, but the additional image and the background image can be superposed and printed. In the additional printed material, even when the margin amount of the background image is large, there is no problem. Conversely, in the main printed material, since printing can be performed without feeding the continuous medium S in reverse direction, the print positions of the main image and the background image are less prone to be shifted and the margin amount of the background image can be reduced.

Although only the non-discharge inspection pattern of the nozzles of the four color inks (YMCK) is formed in FIG. 3, the invention is not limited thereto and, as shown in FIG. 7, the non-discharge inspection pattern of the white nozzle may be printed as the additional image. Since the white ink is easier to see on the transparent medium as compared with the other color inks (YMCK), the non-discharge inspection pattern of the white nozzle may not be superposed and printed on the background image.

The background image of the other color inks (for example, the black ink) may be superposed and printed on the non-discharge inspection pattern of the white nozzle using the white ink. For example, as shown in FIG. 7, if the first white head 31 (W1) according to the printing mode of the main printed material is used and the printing modes of the main printed material and the additional printed material are different, after the non-discharge inspection pattern is printed by the four color ink heads 31 (YMCK), the continuous medium S is fed in reverse direction and the background image is printed by the first white head 31 (W1) of the upstream side. In contrast, in the non-discharge inspection pattern of the white nozzle, the non-discharge inspection pattern is first printed by the first white head 31 (W1) of the upstream side, the black background image is printed on the non-discharge inspection pattern of the white nozzle by the black head 31 (K) while transporting the continuous medium S to the downstream side. That is, unlike the non-discharge inspection pattern of the four color ink nozzles, the continuous medium S does not need to be fed in reverse direction by the non-discharge inspection pattern of the white nozzle.

If the printing modes of the main printed material and the additional printed mode are different, the background image is commonly used and the main printed material and the additional printed material can be printed on the same position of the continuous medium S. In this case, it is possible to reduce the consumption amount of the continuous medium S. Therefore, as the result of setting the printing modes of the printed materials by the main image setting unit 141 and the additional image setting unit 142, if the printing modes of the main printed material and the additional printed material are different, the user may select whether or not the main image and the additional image are printed on the same position through the background image.

Second Embodiment

Figure 8:
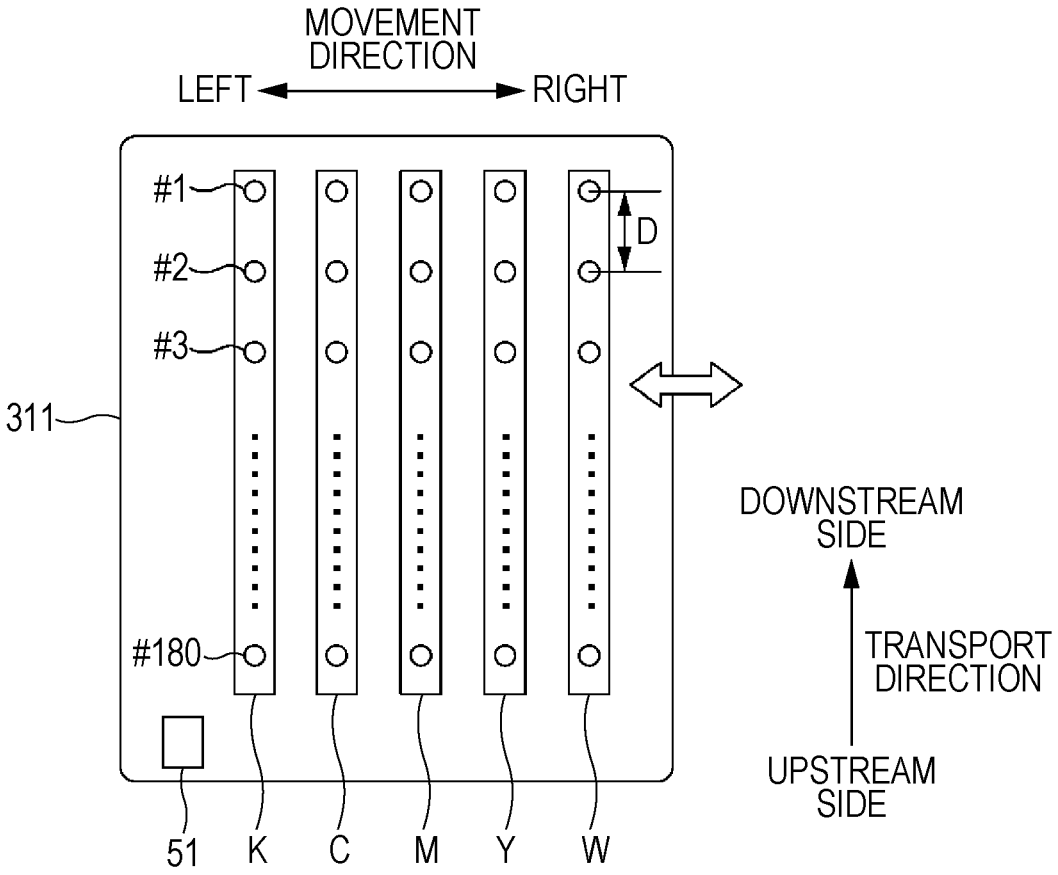
FIG. 8 is a diagram showing a head included in a printer according to a second embodiment.

FIG. 8 is a diagram showing a short head 311 included in a printer according to a second embodiment. Although the printer 1 for transporting the continuous medium S under the head 31, in which the short heads 311 are arranged, in the paper width direction without stoppage is described in the first embodiment as shown in FIG. 2B, the invention is not limited thereto. In the second embodiment, there is provided a printer for repeating an operation for discharging the inks from the nozzles and a transport operation for transporting the medium (cut sheet) in a nozzle array direction while moving one short head 311 shown in FIG. 8 in a movement direction intersecting the nozzle array direction. In addition, an operation for forming an image by moving the short head 311 once in the movement direction is called "pass". FIG. 8 is a diagram virtually showing the arrangement of the nozzles and the reading sensor 51 from the upper surface of the short head 311. In the lower surface of the short head 311, nozzle arrays for discharging the four color inks (YMCK) and the white ink (W) are provided. Each nozzle array is configured by aligning 180 nozzles at a predetermined interval D in the transport direction, and a small number is sequentially attached from a nozzle of the downstream side of the transport direction (#1 to #180). The reading sensor 51 for reading the additional image is provided at a position of an upstream side of the nozzle arrays in the transport direction. In addition, in the embodiment of FIG. 8, after the additional image is printed, the additional image needs to be read by feeding the medium in the direction opposed to the transport direction. The reading sensor 51 may be provided on the downstream side of the short head 311 in the transport direction. In this case, the additional image can be read without feeding the medium, on which the additional image is printed, in reverse direction.

Figure 9:
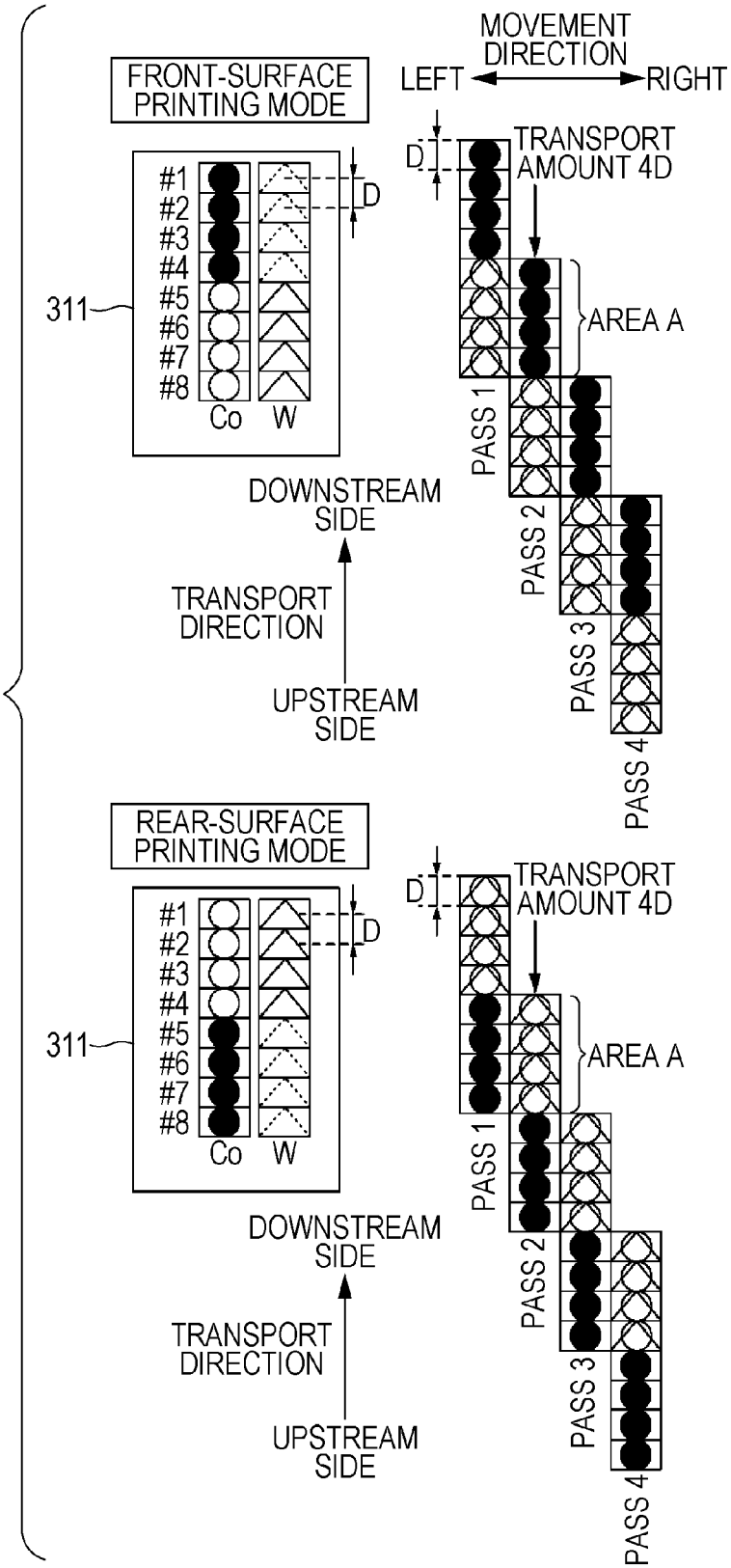
FIG. 9 is a diagram showing a front-surface printing mode and a rear-surface printing mode in the printer according to the second embodiment.

FIG. 9 is a diagram showing a front-surface printing mode and a rear-surface printing mode in the printer according to the second embodiment. Here, even in the printer of the second embodiment, as shown in FIG. 3, the main printed material obtained by superposing the main image using the four color inks (YMCK) and the background image of the white ink and the additional printed material obtained by superposing the additional image using the four color inks and the background image of the white ink are printed. In the case where the two images are superimposed and printed, as shown in FIG. 4, either the front-surface printing mode or the rear-surface printing mode is selected. The main image setting unit and the additional image setting unit are provided in the printer (controller) so as to independently set the printing mode of the main printed material and the printing mode of the additional printed material. For example, the main image setting unit may determine the printing mode of the main printed material based on the setting of the user similar to the flowchart shown in FIG. 5. The additional image setting unit may determine the printing mode of the additional printed material depending on whether or not the additional image is read by the reading sensor 51 as shown in the flowchart of FIG. 6A. However, in the printer of the second embodiment, since the image is printed on a cut sheet and the medium is not rolled in the roll shape, for example, the user may select the printing mode if reading is not performed by the reading sensor 51.

Here, an example of printing the background image in which the hue of the white color is adjusted is illustrated. If the background image is printed using only the white ink, the color of the white ink used to print the background image becomes the color of the background image. However, even for the same white ink, the hue of the white color is slightly varied depending on the material of the ink or the like. Accordingly, the background image of a color different from a color desired by the user may be printed by the used white ink. In a certain printed material, a background image having a slight chromatic color may be desired to be used instead of a simple white color. If a white medium is used, even in the same white medium, the hue of the white color varies slightly depending on the type of the medium. Therefore, when the background image is printed on the white medium, the white color of the background image may be different from the white color of the medium. Thus, the background image becomes conspicuous.

The background image of a desired white color (background image of an adjusted white color) may be printed using appropriate small amounts of color inks (YMCK) together with the white ink. That is, when the background image is printed, at least one of the color inks capable of being discharged from the printer 1 may be used. For example, all four color inks may be used or color inks of two colors may be used. In the case where the white ink has a slight hue by printing the background image using the white ink and the color inks, the background image may be approximated to an achromatic color by printing the background image together with an ink for canceling the hue.

In addition, printing data for printing the background image of the desired white color in the printer 1 may be stored in the printer 1 in advance or prepared by the printer driver. In the case where the user views the screen of the computer or the monitor of the printer 1 and selects the desired color of the background image, the printing data of the background image according to the selected color may be generated.

In the short head 311 of FIG. 9, for simplification of description, the number of nozzles per one nozzle array is reduced to 8 (#1 to #8) and the nozzle array of four color inks (YMCK corresponding to a first ink) are drawn together as one color nozzle array "Co (corresponding to a first nozzle array)". The nozzles of the color nozzle array Co are denoted by a circle and the nozzles of the white nozzle array W (corresponding to a second nozzle array) for discharging a white ink (corresponding to a second ink) are denoted by a triangle. The upper diagram of FIG. 9 shows printing of the front-surface printing mode. In the printer of the second embodiment, the positions of the used nozzles (discharged nozzles) of the nozzle array are differentiated by a first formed image and a subsequently formed image in a predetermined area on a medium. In the front-surface printing mode, since the background image is first printed in the predetermined area on the medium and the main image or the additional image is printed on the background image, the nozzles #5 to #8 (Δ) corresponding to half of the upstream side of the transport direction of a white nozzle array W and nozzles #5 to #8 (O) corresponding to half of the upstream side of the transport direction of the color nozzle array Co are used as the discharge nozzles for the background image, and the nozzles #1 to #4 (●) corresponding to half of the downstream side of the transport direction of the color nozzle array Co are used as the discharge nozzles for the main image. In addition, the image formed by the printing method shown in FIG. 9 is configured such that the image formed in one pass is aligned in the transport direction. Accordingly, the medium transport amount of one transport operation becomes an image width (4D) formed using half (four nozzles) of the nozzle array in one pass.

Since the nozzles #5 to #8 for forming the background image are located on the upstream side of the nozzles #1 to #4 for forming the main image or the additional image in the transport direction, the background image can be first printed in the predetermined area on the medium and, thereafter, the main image or the additional image can be printed on the background image. In the right of the upper diagram of FIG. 9, the discharge nozzles #5 to #8 for the background image and the discharge nozzles #1 to #4 for the main image or the additional image are shown as one nozzle array and the positional relationship between dots formed in each pass is shown. As can be seen from this drawing, for example, after the background image is printed by the upstream nozzles #5 to #8 of the white nozzle array W and the color nozzle array Co in Pass 1 in the area A on the medium, the main image or the additional image is printed on the background image by the downstream nozzles #1 to #4 of the color nozzle array Co in Pass 2.

As shown in the lower diagram of FIG. 9, in the rear-surface printing mode, the nozzles #1 to #4 (Δ) corresponding to half of the downstream side of the transport direction of the white nozzle array W and nozzles #1 to #4 (O) corresponding to half of the downstream side of the transport direction of a color nozzle array Co are used as the discharge nozzles for the background image, and the nozzles #5 to #8 (●) corresponding to half of the upstream side of the color nozzle array Co in the transport direction are used as the discharge nozzles for the main image. In this way, as shown in the right of the lower diagram of FIG. 9, after the main image or the additional image is first printed by the upstream nozzles #5 to #8 of the color nozzle array Co in Pass 1 in the area A on the medium, the background image is printed on the main image or the additional image by the downstream nozzles #1 to #4 of the white nozzle array W and the color nozzle array Co in Pass 2.

In the printer which repeats the operation for moving the short heads 311 in the movement direction and forming the image and the operation for transporting the medium in the transport direction, the nozzles for first printing the image in the predetermined area on the medium is set to upstream nozzles in the transport direction rather than the nozzles for subsequently printing the image. When two images are superposed and printed, since the first formed image and the subsequently formed image can be printed in different passes, it is possible to secure the drying time of the first formed image. As a result, even when two images are superposed and printed, it is possible to suppress blurring of the image.

Even in the second embodiment, the printing modes of the main image and the additional image are independently set, similarly to the first embodiment. Therefore, the printing mode of the main image and the printing mode of the additional image may be different. As shown in FIG. 9, if the printing modes are different, the discharge nozzles for the main images are different. If the non-discharge inspection pattern is, for example, printed as the additional image, the non-discharge inspection pattern needs to be formed by the color nozzles for printing the main image. Even when it is not the non-discharge inspection pattern, since the ink is thickened in the nozzles which are not used for printing the main image and the ink may not be normally discharged, it is preferable that the color nozzles for printing the main image and the color nozzles for printing the additional image are equal to each other. Therefore, even when the printing mode of the main image and the printing mode of the additional image are different, the color nozzles for printing the main image and the additional image may be equalized. Similarly, even in the nozzles for printing the background image, since the white nozzles which are not used for printing the background image for the main image may be dried, it is preferable that the nozzles for printing the background image for the main image and the nozzles for printing the background image for the additional image are equalized.

For example, the main printed material is printed in the front-surface printing mode and the additional printed material is printed in the rear-surface printing mode on the upstream side of the main printed material in the transport direction. At this time, in order to print the main printed material, while the medium is transported from the upstream side to the downstream side in the transport direction, as shown in the upper diagram of FIG. 9, the background image is printed by the upstream nozzles #5 to #8 of the white nozzle array W and the color nozzle array Co and the main image is printed by the downstream nozzles #1 to #4 of the color nozzle array Co. As a result, the main image can be printed on the background image.

Meanwhile, in order to print the additional printed material, first, while the medium is transported from the upstream side to the downstream side in the transport direction, the additional image (for example, the non-discharge inspection pattern) is printed by the downstream nozzles #1 to #4 of the color nozzle array Co. Thereafter, since the additional printed material is printed in the rear-surface printing mode, the medium is fed in reverse direction from the downstream side to the upstream side in the transport direction such that the medium portion on which the additional image is printed is located on the upstream side of the upstream nozzles #5 to #8 of the white nozzle array W and the color nozzle array Co. Therefore, while the medium is transported from the upstream side to the downstream side in the transport direction, the background image is printed on the additional image by the upstream nozzles #5 to #8 of the white nozzle array W and the color nozzle array Co.

As a result, even when the printing mode of the main printed material and the printing mode of the additional printed material are different, the nozzles for printing the main image and the nozzles for printing the additional image can be equalized and thus the nozzles for printing the background image for the main image and the nozzles for printing the background image for the additional image can be equalized. Therefore, the non-discharge inspection pattern for checking the non-discharge of the nozzles for printing the main image can be formed, the additional printed material (or the main printed material) can be printed by the nozzles used for printing the main printed material (or the additional printed material), and the image can be formed by the nozzles hardly causing the non-discharge due to ink thickening. When the additional printed material is printed, since the medium is transported from the downstream side to the upstream side of the transport direction, the positions of the additional image and the background image for the additional image are prone to be shifted. Similarly to the image of FIG. 7, the margin amount of the background image for the main image may be greater than the margin amount of the background image for the additional image.

The position of the transport direction of the nozzles of the white nozzle array W for printing the background image and the position of the transport direction of the nozzles of the color nozzle array Co for printing the background image are equalized. In order to print the background image, the white ink and the color ink are discharged to the predetermined area of the medium in the same pass. As a result, the white ink and the color ink are mixed so as to deteriorate granularity of the background image.

The ratio of the color ink configuring the background image is less than the ratio of the white ink. In order to reduce granularity of the color ink in the background image, it is preferable that the dots of the color ink are uniformly dispersed. That is, the color ink density (dot density) per unit area of the background image is less than the white ink density (dot density) per unit area of the background image. Therefore, the ratio of the color ink configuring the background image is less than the ratio of the white ink, but the number of nozzles of the white nozzle array W used for printing the background image and the number of nozzles of the color nozzle array Co are equalized. That is, the background image is printed using the nozzles corresponding to a half of the color nozzle array Co. The invention is not limited thereto and the background image may be printed at intervals of several nozzles of the nozzles corresponding to a half of the color nozzle array Co which can be used for printing the background image.

Figure 10:
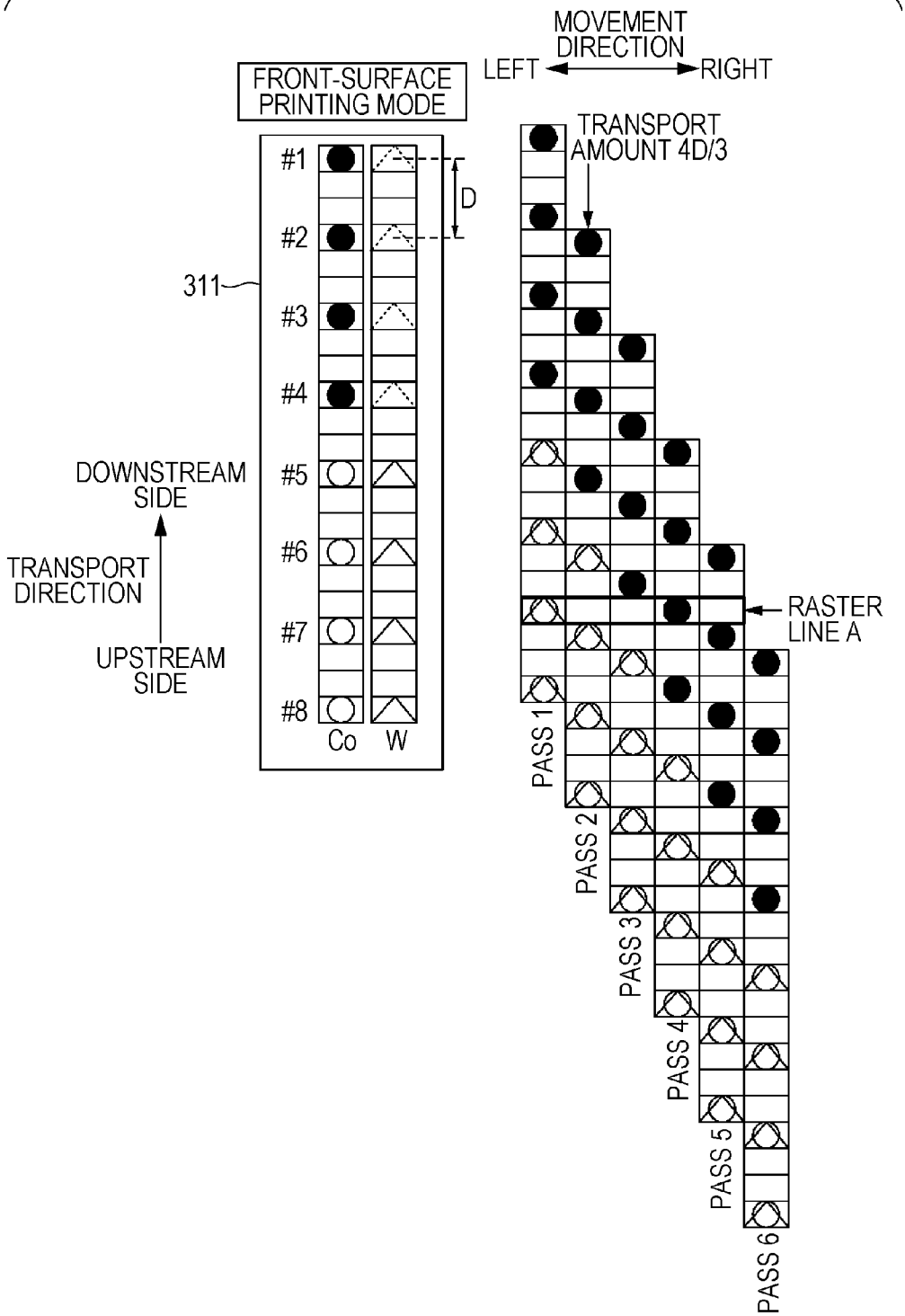
FIG. 10 is a diagram showing another printing method.

FIG. 10 is a diagram showing another printing method. In the printing method shown in FIG. 9, an image in which the images formed in one pass are aligned in the transport direction is printed, and a raster line in another pass cannot be formed between raster lines (dot array along the movement direction) formed in a certain pass. In contrast, in FIG. 10, the printing method with high printing resolution in the transport direction is shown and the printing method of the front-surface printing mode is shown. Similar to FIG. 9, in the front-surface printing mode, the nozzles located on the upstream side of the nozzles #1 to #4 for the subsequently printed main image or the additional image in the transport direction are set as the nozzles #5 to #8 for the first printed background image. Unlike FIG. 9, the medium transport amount (4D/3) of one transport operation is reduced. Therefore, in the printing method shown in FIG. 10, the printing resolution in the transport direction can be increased, but the printing time is increased, as compared with the printing method of FIG. 9. In the printing method of FIG. 10, for example, similar to the raster line A shown in the right side of the drawing, after the dots for the background image are formed by the white nozzle and the color nozzles (Δ and O) of Pass 1, the dots for the main image or the additional image are formed by the color nozzles (●) of Pass 4. Therefore, in the printing method shown in FIG. 10, it is possible to increase the drying time from a time when the previous image (background image, in FIG. 10) is printed to a time when the subsequent image (main image or additional image) is printed, as compared with the printing method shown in FIG. 9.

Figure 11A:
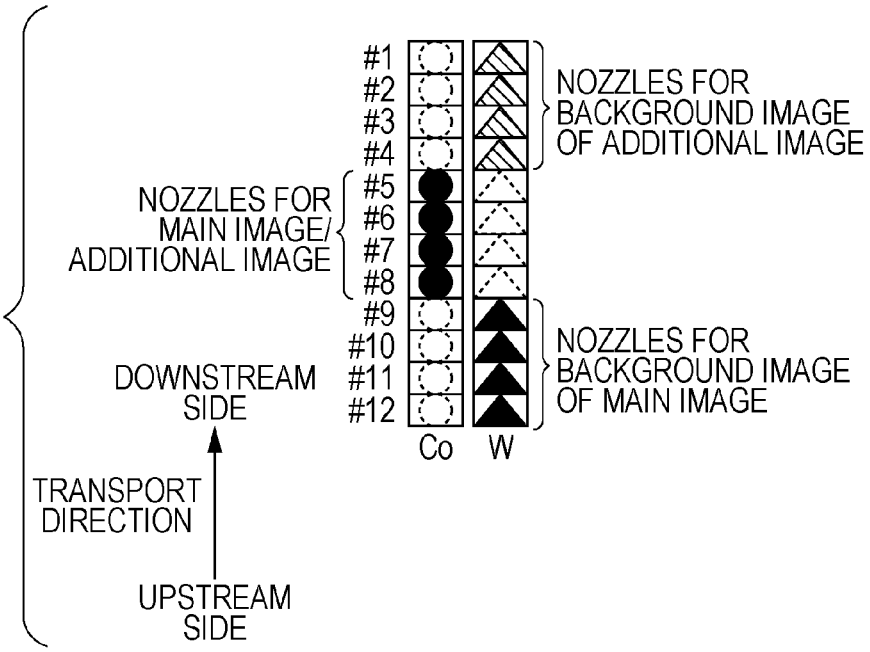
FIGS. 11A and 11B are diagrams explaining a printing method of differentiating nozzles for a background image in a main printed material and an additional printed material.
Figure 11B:
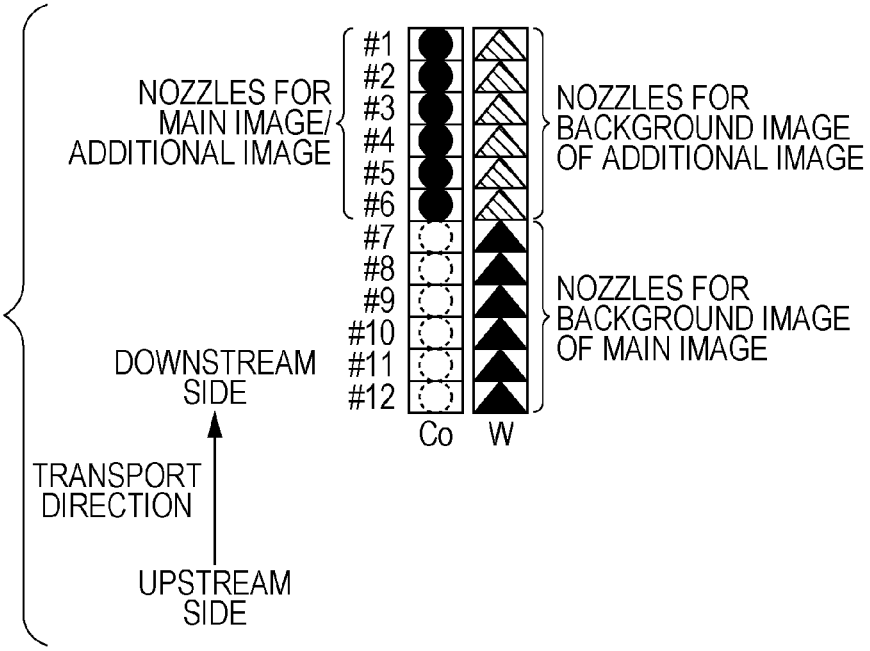

FIGS. 11A and 11B are diagrams explaining a printing method of differentiating nozzles for a background image in the main printed material and the additional printed material. For description, the number of nozzles per one nozzle array is reduced. As described above, in particular, in the case where the non-discharge inspection pattern is printed as the additional image, the non-discharge inspection pattern needs to be formed by the nozzles for printing the main image. Since the ink is thickened in the nozzles which are not used for printing the main image and the ink may not be normally discharged, it is preferable that the nozzles for printing the main image and the nozzles for printing the additional image are the same. Meanwhile, as compared with the main image or the additional image, even when a non-discharge nozzle is present in the nozzles for printing the background, image quality is not influenced. Therefore, the nozzles for the background image of the main image and the nozzle for background image of the additional image may be different.

In the case that the main printed material and the additional printed material are printed in different printing modes, as shown in FIG. 11A, the nozzles corresponding to ⅓ of the upstream side of the transport direction and the nozzles corresponding to ⅓ of the downstream side of the transport direction of the white nozzle array W may be used as the nozzles for the background image and the nozzles corresponding to ⅓ of the central portion of the transport direction of the color nozzle array Co may be used as the nozzles for the main image and the additional image. For example, FIG. 11A shows the nozzles in the case where the main printed material is printed in the front-surface printing mode and the additional printed material is printed in the rear-surface printing mode. First, while the medium is transported from the upstream side to the downstream side, the background image for the main image is printed in a predetermined area on the medium by the upstream nozzles #9 to #12 of the white nozzle array W and, thereafter, the main image is printed on the background image of the predetermined area by the nozzles #5 to #8 of the central portion of the color nozzle array Co. Then, while the medium is transported from the upstream side to the downstream, the additional image is printed in another area on the medium by the nozzles #5 to #8 of the central portion of the color nozzle array Co and, thereafter, the background image is printed on the additional image by the downstream side nozzles #1 to #4 of the white nozzle array W.

Even when the printing modes of the main printed material and the additional printed material are different, since the nozzles of the white nozzle array W of the upstream side (one side) and the downstream side (the other side) of the transport direction (predetermined direction) of the discharge nozzles of the color nozzle array Co are used as the nozzles for the background image, the medium does not need to be fed in reverse direction from the downstream side to the upstream side of the transport direction. In addition, even when the nozzles for the background image of the main image and the nozzles for the background image of the additional image are different, since the cleaning (for example, flushing) of the nozzles for the background image is periodically performed, the ink droplets can be discharged from the nozzles for the background image with certainty.

As shown in FIG. 11B, in the case where the main printed material and the additional printed material are printed in different printing modes, the position of the transport direction of the nozzles of the color nozzle array Co for printing the additional image and the position of the transport direction of the nozzles of the white nozzle array W for printing the background image of the additional image may be equalized. In detail, in FIG. 11B, the main printed material is printed in the front-surface printing mode, the additional printed material is printed in the rear-surface printing mode, and, while the medium is transported from the upstream side to the downstream side, the background image of the main image is first printed by the nozzles #7 to #12 corresponding to half of the upstream side of the white nozzle array W. Next, the main image is printed on the background image of the main image by the nozzles #1 to #6 corresponding to half of the downstream side of the color nozzle array Co, and the additional image is printed in another area on the medium. Then, after the drying time of the additional image is provided without transporting the medium, the background image is printed on the additional image by the nozzles #1 to #6 corresponding to half of the upstream side of the white nozzle array W. Therefore, even when the printing modes of the main printed material and the additional printed material are different, printing can be performed without feeding the medium from the downstream side to the upstream side of the transport direction in reverse direction.

In addition, although the background image printed using only the white ink is described in FIGS. 11A and 11B, the invention is not limited thereto. As shown in FIGS. 9 and 10, the background image in which the hue of the white color is adjusted may be printed using the nozzles of the color nozzle array Co located on the same position of the transport direction as the nozzles of the white nozzle array W for printing the background image. In this case, in the printing example of FIG. 11A, the nozzles #9 to #12 of ⅓ of the upstream side of the white nozzle array W and the color nozzle array Co become the discharge nozzles for the background image of the main image and the nozzles #1 to #4 of ⅓ of the downstream side of the white nozzle array W and the color nozzle array Co become the discharge nozzles for the background image of the additional image. In the printing example of FIG. 11B, the nozzles #7 to #12 of half of the upstream side of the white nozzle array W and the color nozzle array Co become the discharge nozzles for the background image of the main image and the nozzles #1 to #6 of half of the downstream side of the white nozzle array W and the color nozzle array Co become the discharge nozzles for the background image of the additional image.

The additional image may have image quality which enables the user to check the information about the printing of the main image and the hue of the background image of the additional image may not need to be adjusted. In this case, the background image of the main image may be printed using the white ink and the color inks in order to adjust the hue of the white color and the background image of the additional image may be printed using only the white ink.

Although the color image is printed using only the four color inks (YMCK) in the above-described printing examples, the invention is not limited thereto. For example, the color image may be printed using the white ink together with the four color inks. In this case, in the front-surface printing mode shown in FIG. 9, the color image is printed using the nozzles #1 to #4 corresponding to half of the downstream side of the transport direction of the color nozzle array Co and the white nozzle array W. In contrast, in the rear-surface printing mode, the color image is printed using the nozzles #5 to #8 corresponding to half of the upstream side of the transport direction of the color nozzle array Co and the white nozzle array W. The position of the transport direction of the nozzles of the color nozzle array Co for printing the color image and the position of the transport direction of the nozzles of the nozzle array W for printing the white image are aligned. Then, in order to print the color image, the color inks and the white ink are discharged to the predetermined area of the medium in the same pass. By printing the color image using the white ink as well as the color inks, it is possible to print an image capable of exhibiting a color with high brightness and high chroma.

Modified Example

Although the background image in which the hue of the white color is adjusted using the white ink and the color ink is described in the printing examples of FIGS. 9 and 10 of the second embodiment, the invention is not limited thereto. The background image may be printed using only the white ink. However, in this case, only the background image of the color corresponding to the white ink can be printed. Therefore, the background image of a desired color cannot be printed and a difference between the color of the background image and the ground color of the medium becomes conspicuous. Accordingly, the background image with high image quality cannot be printed. Hereinafter, a printing example in the case where the background image is printed using only the white ink will be described.

Figure 12:
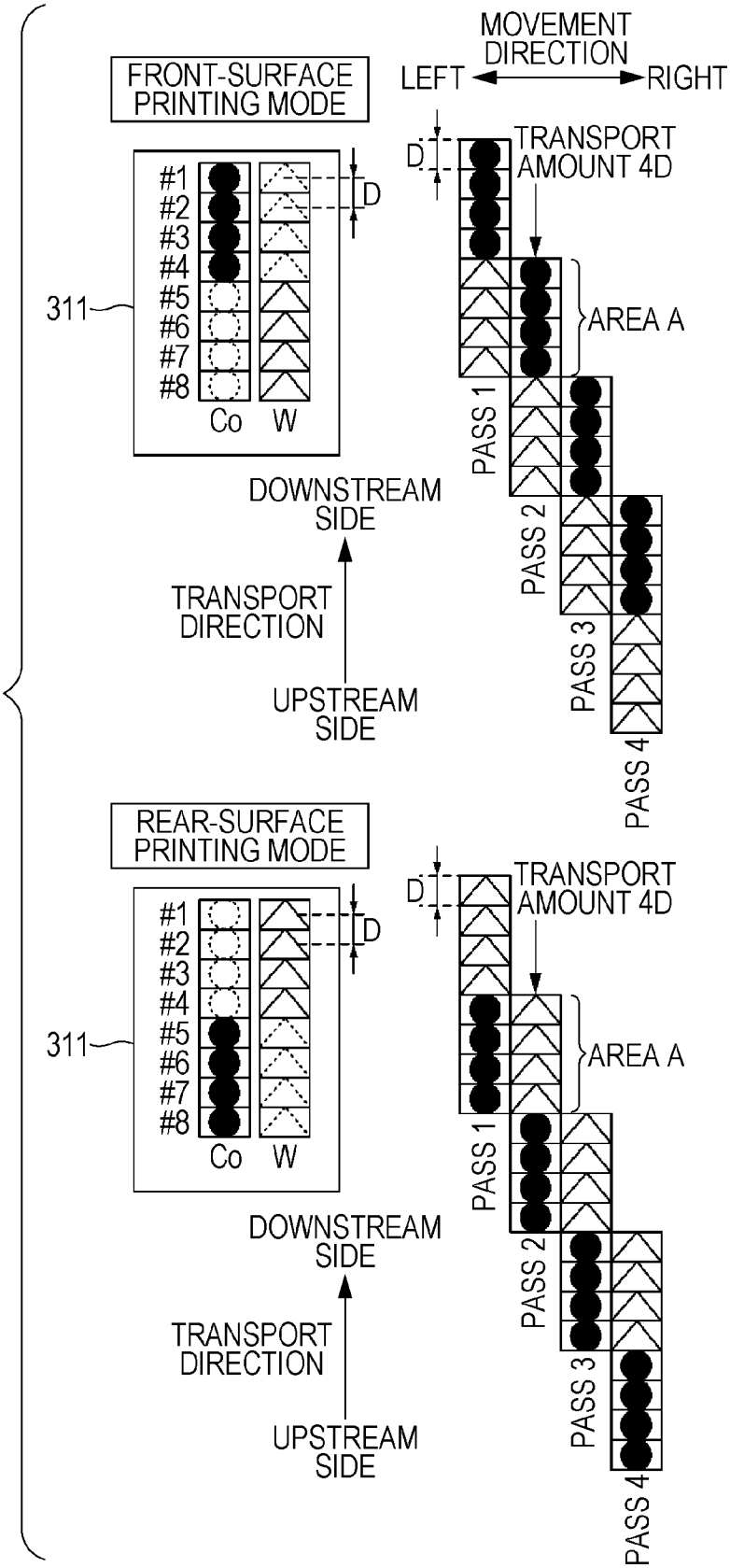
FIG. 12 is a diagram showing a front-surface printing mode and a rear-surface printing mode in the printer according to the second embodiment.

FIG. 12 is a diagram showing the front-surface printing mode and the rear-surface printing mode in the printer according to the second embodiment. Here, even in the printer of the second embodiment, as shown in FIG. 3, the main printed material obtained by superposing the main image using the four color inks (YMCK) and the background image of the white ink and the additional printed material obtained by superposing the additional image using the four color inks and the background image of the white ink are printed. In the case where the two images are superimposed and printed, as shown in FIG. 4, either the front-surface printing mode or the rear-surface printing mode is selected. The main image setting unit and the additional image setting unit are provided in the printer (controller) so as to independently set the printing mode of the main printed material and the printing mode of the additional printed material. For example, the main image setting unit may determine the printing mode of the main printed material based on the setting of the user similar to the flowchart shown in FIG. 5. The additional image setting unit may determine the printing mode of the additional printed material depending on whether or not the additional image is read by the reading sensor 51 as shown in the flowchart of FIG. 6A. However, in the printer of the second embodiment, since the image is printed on a cut sheet and the medium is not rolled in the roll shape, for example, the user may select the printing mode if reading is not performed by the reading sensor 51.

In the short head 311 of FIG. 12, for simplification of description, the number of nozzles per one nozzle array is reduced to 8 (#1 to #8) and four color inks (YMCK) are drawn together as one color nozzle array "Co". The nozzles of the color nozzle array Co are denoted by a circle and the nozzles of the white nozzle array W for discharging a white ink are denoted by a triangle. The upper diagram of FIG. 12 shows printing of the front-surface printing mode. In the printer of the second embodiment, the positions of the used nozzles (discharged nozzles) of the nozzle array are differentiated by a first formed image and a subsequently formed image in a predetermined area on a medium. In the front-surface printing mode, since the background image is first printed in the predetermined area on the medium and the main image or the additional image is printed on the background image, the nozzles #5 to #8 corresponding to a half of the upstream side of the transport direction of the white nozzle array W are used as the discharge nozzles (Δ) and nozzles #1 to #4 corresponding to a half of the downstream side of the transport direction of the color nozzle array Co are used as the discharge nozzles (●). In addition, the image formed by the printing method shown in FIG. 12 is configured such that the image formed in one pass is aligned in the transport direction. Accordingly, the medium transport amount of one transport operation becomes an image width (4D) formed in half (four nozzles) of the nozzle array in one pass.

Since the nozzles #5 to #8 for forming the background image are located on the upstream side of the nozzles #1 to #4 for forming the main image or the additional image in the transport direction, the background image can be first printed in the predetermined area on the medium and, thereafter, the main image or the additional image can be printed on the background image. In the right of the upper diagram of FIG. 12, the discharge nozzles #5 to #8 for the background image and the discharge nozzles #1 to #4 for the main image or the additional image are shown in one nozzle array and the positional relationship between dots formed in each pass is shown. As can be seen from this drawing, for example, after the background image is printed by the upstream nozzles #5 to #8 of the white nozzle array W in Pass 1 in the area A on the medium, the main image or the additional image is printed on the background image by the downstream nozzles #1 to #4 of the color nozzle array Co in Pass 2.

As shown in the lower diagram of FIG. 12, in the rear-surface printing mode, the nozzles #1 to #4 corresponding to half of the downstream side of the transport direction of the white nozzle array W are used as the discharge nozzles (A), and the nozzles #5 to #8 corresponding to half of the upstream side of the transport direction of the color nozzle array Co are used as the discharge nozzles (●). As shown in the right of the lower diagram of FIG. 12, after the main image or the additional image is first printed by the upstream nozzles #5 to #8 of the color nozzle array Co in Pass 1 in the area A on the medium, the background image is printed on the main image or the additional image by the downstream nozzles #1 to #4 of the white nozzle array W in Pass 2.

In the printer which repeats the operation for moving the short heads 311 in the movement direction and forming the image and the operation for transporting the medium in the transport direction, the nozzles for first printing the image in the predetermined area on the medium is set to upstream nozzles in the transport direction rather than the nozzles for subsequently printing the image. By doing this, when two images are superposed and printed, since the first formed image and the subsequently formed image can be printed in different passes, it is possible to secure the drying time of the first formed image. As a result, even when two images are superposed and printed, it is possible to suppress blurring of the image.

Even in the second embodiment, the printing modes of the main image and the additional image are independently set, similarly to the first embodiment. Therefore, the printing mode of the main image and the printing mode of the additional image may be different. As shown in FIG. 12, if the printing modes are different, the discharge nozzles for the color nozzle array Co are different. If the non-discharge inspection pattern is, for example, printed as the additional image, the non-discharge inspection pattern needs to be formed by the color nozzles for printing the main image. Even when it is not the non-discharge inspection pattern, since the ink is thickened in the nozzles which are not used for printing the main image and the ink may not be normally discharged, it is preferable that the color nozzles for printing the main image and the color nozzles for printing the additional image are equal to each other. Therefore, even when the printing mode of the main image and the printing mode of the additional image are different, the color nozzles for printing the main image and the additional image may be equalized. Similarly, even in the nozzles for printing the background image, since the white nozzles which are not used for printing the background image for the main image may be dried, it is preferable that the nozzles for printing the background image for the main image and the nozzles for printing the background image for the additional image are equalized.

For example, the main printed material is printed in the front-surface printing mode and the additional printed material is printed in the rear-surface printing mode on the upstream side of the main printed material in the transport direction. At this time, in order to print the main printed material, while the medium is transported from the upstream side to the downstream side of the transport direction, as shown in the upper diagram of FIG. 12, the background image is printed by the upstream nozzles #5 to #8 of the white nozzle array W and the main image is printed by the downstream nozzles #1 to #4 of the color nozzle array Co. As a result, the main image can be printed on the background image.

Meanwhile, in order to print the additional printed material, first, while the medium is transported from the upstream side to the downstream side of the transport direction, the additional image (for example, the non-discharge inspection pattern) is printed by the downstream nozzles #1 to #4 of the color nozzle array Co. Thereafter, since the additional printed material is printed in the rear-surface printing mode, the medium is fed in reverse direction from the downstream side to the upstream side of the transport direction such that the medium portion on which the additional image is printed is located on the upstream side of the upstream nozzles #5 to #8 of the white nozzle array W. Therefore, while the medium is transported from the upstream side to the downstream side of the transport direction, the background image is printed on the additional image by the upstream nozzles #5 to #8 of the white nozzle array W.

As a result, even when the printing mode of the main printed material and the printing mode of the additional printed material are different, the nozzles for printing the main image and the nozzles for printing the additional image can be equalized and thus the nozzles for printing the background image for the main image and the nozzles for printing the background image for the additional image can be equalized. Therefore, the non-discharge inspection pattern for checking the non-discharge of the nozzles for printing the main image can be formed, the additional printed material (or the main printed material) can be printed by the nozzles used for printing the main printed material (or the additional printed material), and the image can be formed by the nozzles hardly causing the non-discharge due to ink thickening. When the additional printed material is printed, since the medium is transported from the downstream side to the upstream side of the transport direction, the positions of the additional image and the background image for the additional image are prone to be shifted. Similar to the image of FIG. 7, the margin amount of the background image for the main image may be greater than the margin amount of the background image for the additional image.

Figure 13:
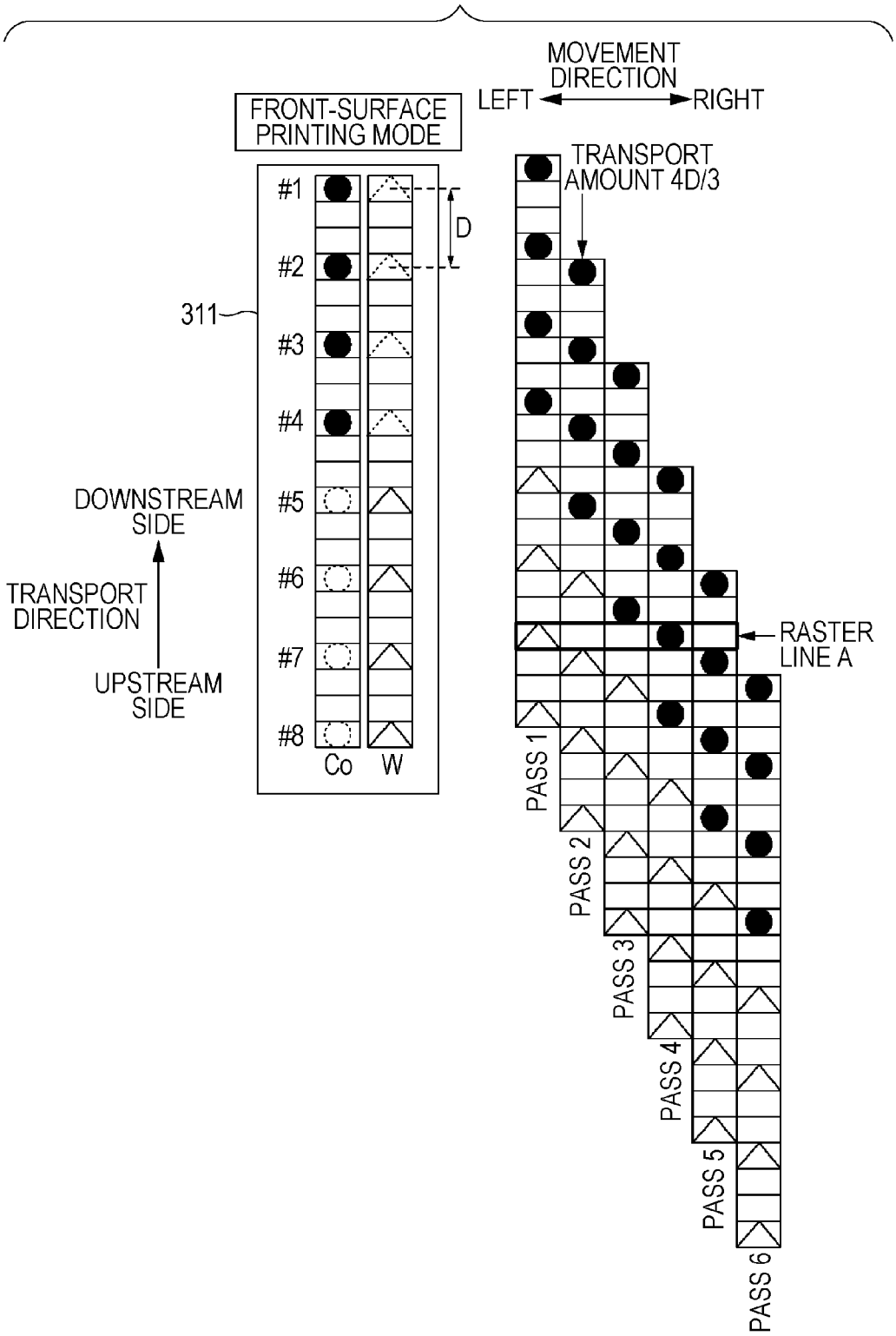
FIG. 13 is a diagram showing another printing method.

FIG. 13 is a diagram showing another printing method. In the printing method shown in FIG. 12, an image in which the images formed in one pass are aligned in the transport direction is printed, and a raster line in another pass cannot be formed between raster lines (dot array along the movement direction) formed in a certain pass. In contrast, in FIG. 13, the printing method with high printing resolution of the transport direction is shown and the printing method of the front-surface printing mode is shown. Similarly to FIG. 12, in the front-surface printing mode, the nozzles located on the upstream side of the nozzles #1 to #4 for the subsequently printed main image or the additional image in the transport direction are set as the nozzles #5 to #8 for the first printed background image. Unlike FIG. 12, the medium transport amount (4D/3) of one transport operation is reduced. Therefore, in the printing method shown in FIG. 13, the printing resolution of the transport direction can be increased, but the printing time is increased, as compared with the printing method of FIG. 12. In the printing method of FIG. 13, for example, similarly to the raster line A shown in the right side of the drawing, after the dots for the background image are formed by the white nozzles (Δ) of Pass 1, the dots for the main image or the additional image are formed by the color nozzles (●) of Pass 4. Therefore, in the printing method shown in FIG. 13, it is possible to increase the drying time from a time when the previous image (background image, in FIG. 13) is printed to a time when the subsequent image (main image or additional image) is printed, as compared with the printing method shown in FIG. 12.

Other Embodiments

Although the printing system having the ink jet printer as a main component is described in the embodiments, the disclosure of the method of setting the printing mode or the like is included. The above embodiments are described to facilitate the understanding of the invention and are not interpreted to restrict the invention. Modifications and changes of the invention may be made without departing from the scope of the invention and the invention includes equivalents thereof.

Regarding Setting of Rear-Surface Printing Mode and Front-Surface Printing Mode of Additional Image The rear-surface printing mode or the front-surface printing mode of the additional image may be set independently of the setting of the rear-surface printing mode or the front-surface printing mode of the main image, and the independent setting is not limited to the above embodiments.

Regarding Image

Although the background image is printed using the white ink in the above embodiments, the invention is not limited thereto and the background image may be printed using a color ink (for example, a metallic ink) other than the white color. Although the background image is printed using only the white ink in the first embodiment, the invention is not limited thereto and the white ink and another color ink may be mixed and the background image in which the hue of the white color is adjusted may be printed. The main image or the additional image may be printed by adding the white ink to the four color inks (YMCK).

Regarding Other Printers

Although the printer (FIG. 2) for forming the image through the continuous medium under the fixed heads 31 or the printer (FIG. 8) for repeating the operation for forming the image while moving the heads 31 in the direction intersecting the nozzle array direction and the operation for transporting the cut sheet in the nozzle array direction is described in the above embodiments, the invention is not limited thereto. For example, a printer for alternately repeating the operation for forming the image with respect to the continuous sheet transported to the printing area while moving the short heads 311 shown in FIG. 8 along the transport direction of the continuous sheet and the operation for moving the short heads 311 in the paper width direction intersecting the transport direction so as to form the image and, thereafter, transporting the medium portion, on which the image is not printed, to the printing area may be used.

Regarding Printing Device

As a method of discharging inks from nozzles, a piezoelectric method of applying a voltage to driving elements (piezoelectric elements) and expanding and contracting ink chambers so as to discharge inks may be used or a thermal method of generating air bubbles in nozzles using a heating element and discharging inks by the air bubbles may be used.

Although the ultraviolet curing type ink is used in the above embodiments, the invention is not limited thereto and, for example, an aqueous ink or an organic solvent ink may be used.

What is claimed is:

1. A printing device for discharging inks from nozzles according to a set mode and printing an image on a medium, the printing device comprising:

a first setting unit configured to set a printing mode of a main image and to set either a front-surface printing mode for printing a background image on the medium and then printing the main image on the background image or a rear-surface printing mode for printing the main image on the medium and then printing the background image on the main image; and a second setting unit configured to set a printing mode of an additional image printed in association with the printing of the main image and to set either a front-surface printing mode for printing a background image for the additional image on the medium and then printing the additional image on the background image for the additional image or a rear-surface printing mode for printing the additional image on the medium and then printing the background image for the additional image on the additional image, wherein, if the additional image is read by a sensor, the second setting unit sets the printing mode of the additional image to a printing mode for printing an image in which the background image for the additional image is not interposed between the sensor and the additional image.

2. The printing device according to claim 1, wherein:

the medium after printing is wound in a roll shape, if the medium is wound in a state in which the printed surface of the medium is located outside, the second setting unit sets the printing mode of the additional image to the front-surface printing mode, and if the medium is wound in a state in which the printed surface of the medium is located inside, the second setting unit sets the printing mode of the additional image to the rear-surface printing mode.

3. The printing device according to claim 1, further comprising a user selection unit for enabling a user to select the printing mode of the main image and the printing mode of the additional image.

4. The printing device according to claim 1, wherein:

the relative position of the medium and the nozzles is relatively moved in one direction of a predetermined direction, the inks are discharged from the nozzles, and the image is printed on the medium, and for the front-surface printing mode and the rear-surface printing mode, if the printing mode of the main image and the printing mode of the additional image are different, the relative position of the medium and the nozzles is relatively moved in the other direction of the predetermined direction before the additional image or the background image for the additional image is printed.

5. The printing device according to claim 4, wherein the margin amount of the background image for the additional image with respect to the additional image is greater than the margin amount of the background image with respect to the main image.

6. The printing device according to claim 1, wherein:

the relative position of the medium and the nozzles is relatively moved in one direction of a predetermined direction, the inks are discharged from the nozzles and the image is printed on the medium, and for the front-surface printing mode and the rear-surface printing mode, if the printing mode of the main image and the printing mode of the additional image are different, one set of the nozzles located on one direction side or the other direction side of the predetermined direction rather than the nozzles for printing the main image and the additional image is used as the nozzle for printing the background image, and the other nozzles are used as nozzles for printing the background image for the additional image.

7. The printing device according to claim 1, wherein the main image is printed by a first ink and the background image is printed by the first ink and a second ink.

8. The printing device according to claim 1, wherein the printing mode of the main image and the printing mode of the additional image are different.

9. A printing method comprising:

at a first setting unit, setting either a front-surface printing mode for printing a background image on a medium and then printing a main image on the background image or a rear-surface printing mode for printing the main image on the medium and then printing the background image on the main image as the printing mode of the main image;

printing the main image and the background image according to the mode set by the first setting unit;

at a second setting unit, setting either a front-surface printing mode for printing a background image for an additional image printed in association with the printing of the main image on the medium and then printing the additional image on the background image for the additional image or a rear-surface printing mode for printing the additional image on the medium and then printing the background image for the additional image on the additional image as the printing mode of the additional image;

printing the additional image and the background image for the additional image according to the mode set by the second setting unit, and wherein, if the additional image is read by a sensor, the second setting unit sets the printing mode of the additional image to a printing mode for printing an image in which the background image for the additional image is not interposed between the sensor and the additional image.

10. A printing device for discharging inks from nozzles according to a set mode and printing an image on a medium, the printing device comprising:

a first setting unit configured to set a printing mode of a main image and to set either a front-surface printing mode for printing a background image on the medium and then printing the main image on the background image or a rear-surface printing mode for printing the main image on the medium and then printing the background image on the main image; and a second setting unit configured to set a printing mode of an additional image printed in association with the printing of the main image and to set either a front-surface printing mode for printing a background image for the additional image on the medium and then printing the additional image on the background image for the additional image or a rear-surface printing mode for printing the additional image on the medium and then printing the background image for the additional image on the additional image, wherein:

the medium after printing is wound in a roll shape, if the medium is wound in a state in which the printed surface of the medium is located outside, the second setting unit sets the printing mode of the additional image to the front-surface printing mode, and if the medium is wound in a state in which the printed surface of the medium is located inside, the second setting unit sets the printing mode of the additional image to the rear-surface printing mode.

* * * * *